US006863382B2

(12) United States Patent
Anagnostopoulos et al.

(10) Patent No.: US 6,863,382 B2
(45) Date of Patent: Mar. 8, 2005

(54) LIQUID EMISSION DEVICE HAVING MEMBRANE WITH INDIVIDUALLY DEFORMABLE PORTIONS, AND METHODS OF OPERATING AND MANUFACTURING SAME

(75) Inventors: Constantine N. Anagnostopoulos, Mendon, NY (US); Michael N. Debar, Rochester, NY (US); Edward P. Furlani, Lancaster, NY (US)

(73) Assignee: Eastman Kodak Company, Rochester, NY (US)

( * ) Notice: Subject to any disclaimer, the term of this patent is extended or adjusted under 35 U.S.C. 154(b) by 30 days.

(21) Appl. No.: 10/360,942

(22) Filed: Feb. 6, 2003

(65) Prior Publication Data

US 2004/0155942 A1 Aug. 12, 2004

(51) Int. Cl.[7] ..... B41J 2/045
(52) U.S. Cl. ..... 347/70
(58) Field of Search ..... 347/54, 55

(56) References Cited

U.S. PATENT DOCUMENTS 5,644,341 A 7/1997 Fuji et al.
5,652,609 A * 7/1997 Scholler et al. ..... 347/54
5,668,579 A 9/1997 Fuji et al.
5,739,831 A 4/1998 Nakamura et al.
6,000,785 A 12/1999 Sakai et al.
6,127,198 A 10/2000 Coleman et al.
6,307,663 B1 10/2001 Kowarz
6,318,841 B1 11/2001 Coleman et al.
6,322,198 B1 11/2001 Higashino et al.
6,345,884 B1 2/2002 Yoon et al.
6,357,865 B1 3/2002 Kubby et al.
2001/0007460 A1 7/2001 Fujii et al.
2001/0023523 A1 9/2001 Kubby et al.
2001/0024325 A1 9/2001 Kowarz et al.

FOREIGN PATENT DOCUMENTS

EP 1 208 982 5/2002
JP 11309855 11/1999

* cited by examiner

*Primary Examiner*—Michael S. Brooke
(74) *Attorney, Agent, or Firm*—William R. Zimmerli

(57) ABSTRACT

An emission device for ejecting a liquid drop, and methods of operating and manufacturing same are provided. The device includes a structure defining a chamber volume adapted to receive a liquid and has a nozzle orifice through which a drop of received liquid can be emitted. The chamber volume defining structure includes a membrane portion having a plurality of individually deformable portions. A controller is adapted to selectively actuate at least one of the plurality of individually deformable portions of the membrane.

27 Claims, 34 Drawing Sheets

LIQUID EMISSION DEVICE HAVING MEMBRANE WITH INDIVIDUALLY DEFORMABLE PORTIONS, AND METHODS OF OPERATING AND MANUFACTURING SAME

FIELD OF THE INVENTION

The present invention relates generally to micro-electromechanical (MEM) drop-on-demand liquid emission devices such as, for example, ink-jet printers, and more particularly such devices which employ an electrostatic actuator for driving liquid from the device.

BACKGROUND OF THE INVENTION

Mechanical grating devices with electrostatic actuators are known for spatial light modulators. U.S. Pat. No. 6,307,663, which issued to Kowarz on Oct. 23, 2001, discloses a mechanical grating device for modulating an incident beam of light by diffraction. The grating device includes an elongated element having a light reflective surface. The elongated element is positioned over a substrate and is supported by a pair of end supports. At least one intermediate support is positioned between the end supports. The device also includes a means for applying a force (for example, an electrostatic force) to the elongated element to cause the element to deform between first and second operating states. U.S. Patent Application Publication No. US 2001/0024325 A1, which published in the names of Kowarz et al. on Sep. 27, 2001, discloses a method of manufacturing a mechanical conformal grating device.

Drop-on-demand liquid emission devices with electrostatic actuators are also known for ink printing systems. U.S. Pat. No. 5,644,341 and U.S. Pat. No. 5,668,579, which issued to Fujii et al. on Jul. 1, 1997 and Sep. 16, 1997, respectively, disclose such devices having electrostatic actuators composed of a single diaphragm and opposed electrode. The diaphragm is distorted by application of a first voltage to the electrode. Relaxation of the diaphragm expels an ink droplet from the device. Other devices that operate on the principle of electrostatic attraction are disclosed in U.S. Pat. No. 5,739,831, U.S. Pat. No. 6,127,198, and U.S. Pat. No. 6,318,841; and in U.S. Publication No. 2001/0023523.

U.S. Pat. No. 6,345,884, teaches a device having an electrostatically deformable membrane with an ink refill hole in the membrane. An electric field applied across the ink deflects the membrane and expels an ink drop.

IEEE Conference Proceeding "MEMS 1998," held Jan. 25–29, 2002 in Heidelberg, Germany, entitled "A Low Power, Small, Electrostatically-Driven Commercial Inkjet Head" by S. Darmisuki, et al., discloses a head made by anodically bonding three substrates, two of glass and one of silicon, to form an ink ejector. Drops from an ink cavity are expelled through an orifice in the top glass plate when a membrane formed in the silicon substrate is first pulled down to contact a conductor on the lower glass plate and subsequently released. There is no electric field in the ink. The device occupies a large area and is expensive to manufacture.

U.S. Pat. No. 6,357,865 by J. Kubby et al. teaches a surface micro-machined drop ejector made with deposited polysilicon layers. Drops from an ink cavity are expelled through an orifice in an upper polysilicon layer when a lower polysilicon layer is first pulled down to contact a conductor and is subsequently released.

In the devices described above, the diaphragm (or membrane, etc.) is actuated (deformed and relaxed) as a whole, or an entire unit, when a drop is desired. As such, there is little control over the size of the ejected drop created during actuation of the diaphragm.

SUMMARY OF THE INVENTION

According to one feature of the present invention, an emission device for ejecting a liquid drop includes a structure defining a chamber volume adapted to receive a liquid having a nozzle orifice through which a drop of received liquid can be emitted and a membrane portion of the chamber volume defining structure. The membrane portion has a plurality of individually deformable portions. A controller is adapted to selectively actuate at least one of the plurality of individually deformable portions.

According to another feature of the present invention, an emission device for ejecting a liquid drop includes a structure defining a chamber volume adapted to receive a liquid having a nozzle orifice through which a drop of received liquid can be emitted and an actuator. The actuator includes a first electrode associated with the chamber volume defining structure and a second electrode. The first electrode has a plurality of deformable portions. A controller is adapted to selectively move at least one of the plurality of deformable portions.

According to another feature of the present invention, a method of operating a liquid emission device includes providing a structure defining a chamber volume adapted to receive a liquid and having a nozzle orifice through which a drop of received liquid can be emitted; providing a member associated with the chamber volume defining structure, the member having a plurality of deformable portions; and selectively actuating at least one of the plurality of deformable portions of the member such that the drop of received liquid is emitted through the nozzle orifice.

According to another feature of the present invention, a method of manufacturing an emission device includes providing a substrate; forming a member on the substrate, the member having a plurality of individually deformable portions; and forming a chamber volume defining structure over the deformable member.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

As described in detail herein below, the present invention provides a liquid emission device and a process for fabricating drop-on-demand liquid emission devices. The most familiar of such devices are used as printheads in inkjet printing systems. Many other applications are emerging which make use of devices similar to inkjet printheads, but which emit liquids (other than inks) that need to be finely metered and deposited with high spatial precision.

Figure 1:
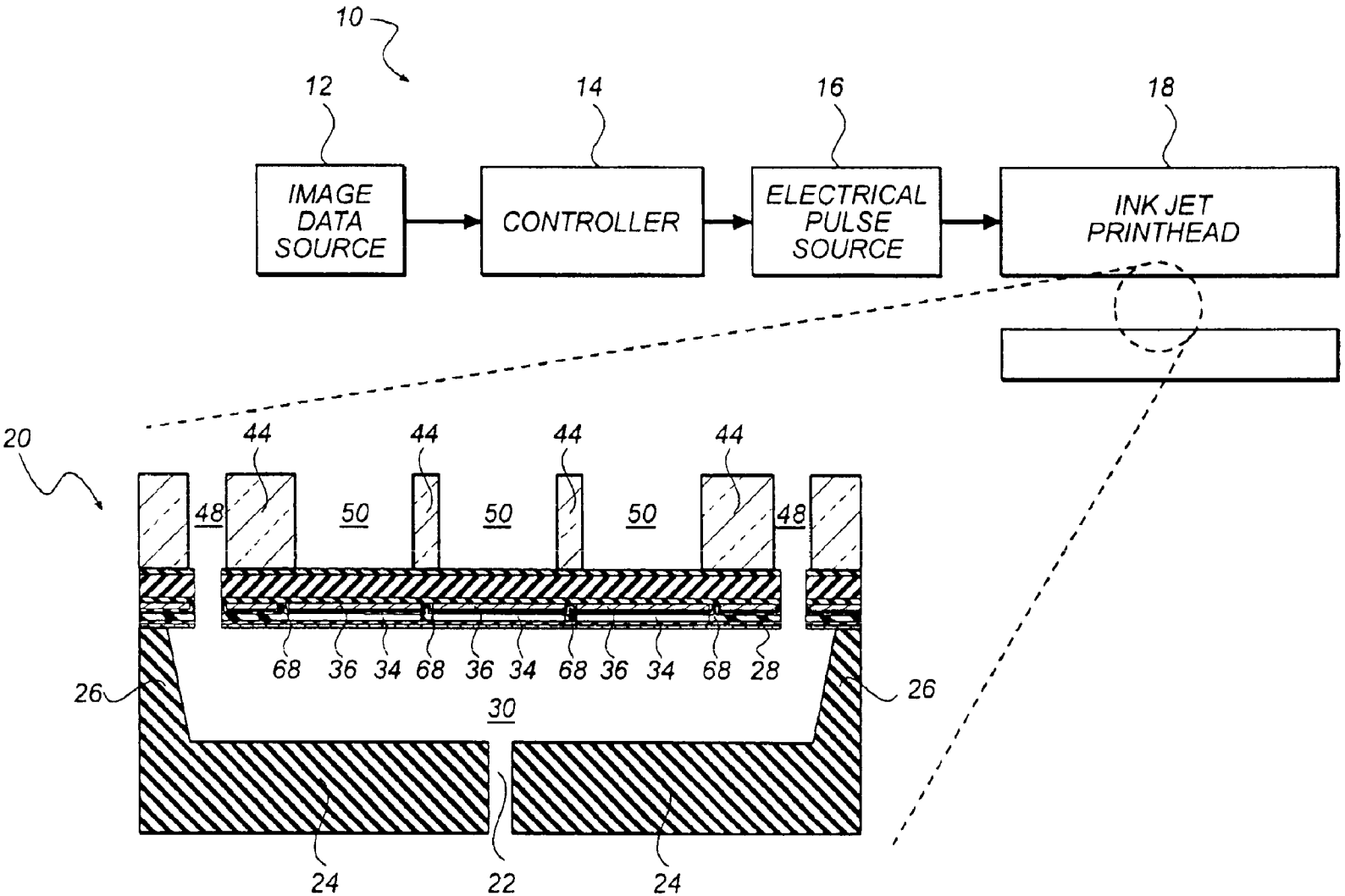
FIG. 1 is a schematic illustration of a drop-on-demand liquid emission device according to the present invention.

FIG. 1 shows a schematic representation of a drop-on-demand liquid emission device 10, such as an inkjet printer, which may be operated according to the present invention. The system includes a source 12 of data (say, image data) which provides signals that are interpreted by a controller 14 as being commands to emit drops. Controller 14 outputs signals to a source 16 of electrical energy pulses which are inputted to a drop-on-demand liquid emission device such as an inkjet printhead 18.

Figure 2:
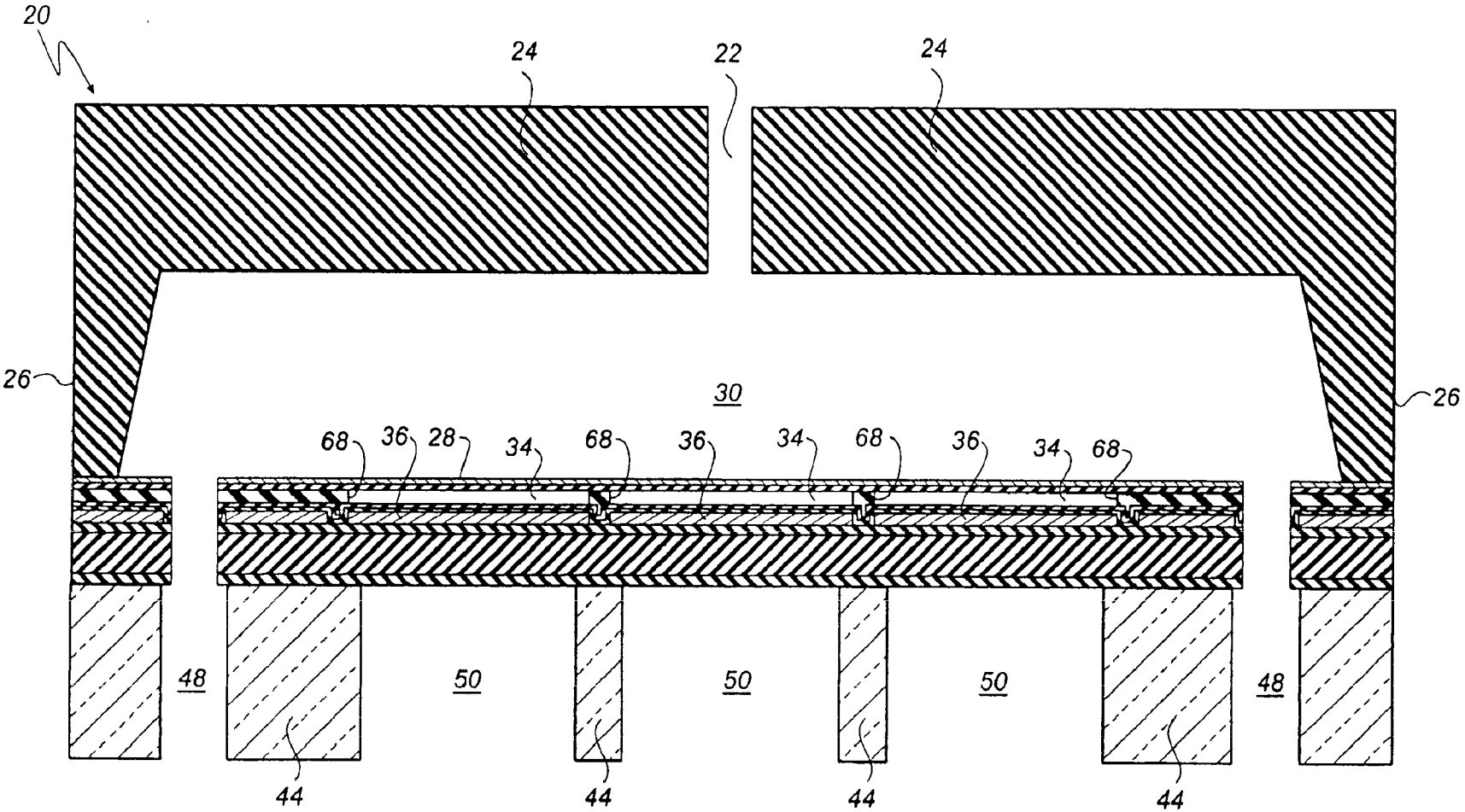
FIG. 2 is a cross-sectional side view of a portion of the drop-on-demand liquid emission device of FIG. 1.

Drop-on-demand liquid emission device 10 includes a plurality of electrostatic drop ejection mechanisms 20. FIG. 2 is a cross-sectional view of one of the plurality of electrostatically actuated drop ejection mechanisms 20. A nozzle orifice 22 is formed in a nozzle plate 24 for each mechanism 20. A wall or walls 26 bound each drop ejection mechanism 20. The wall(s) 26 may comprise a single material as shown in FIG. 2, or may comprise a stack of material layers, as is known in the art.

Figure 8:
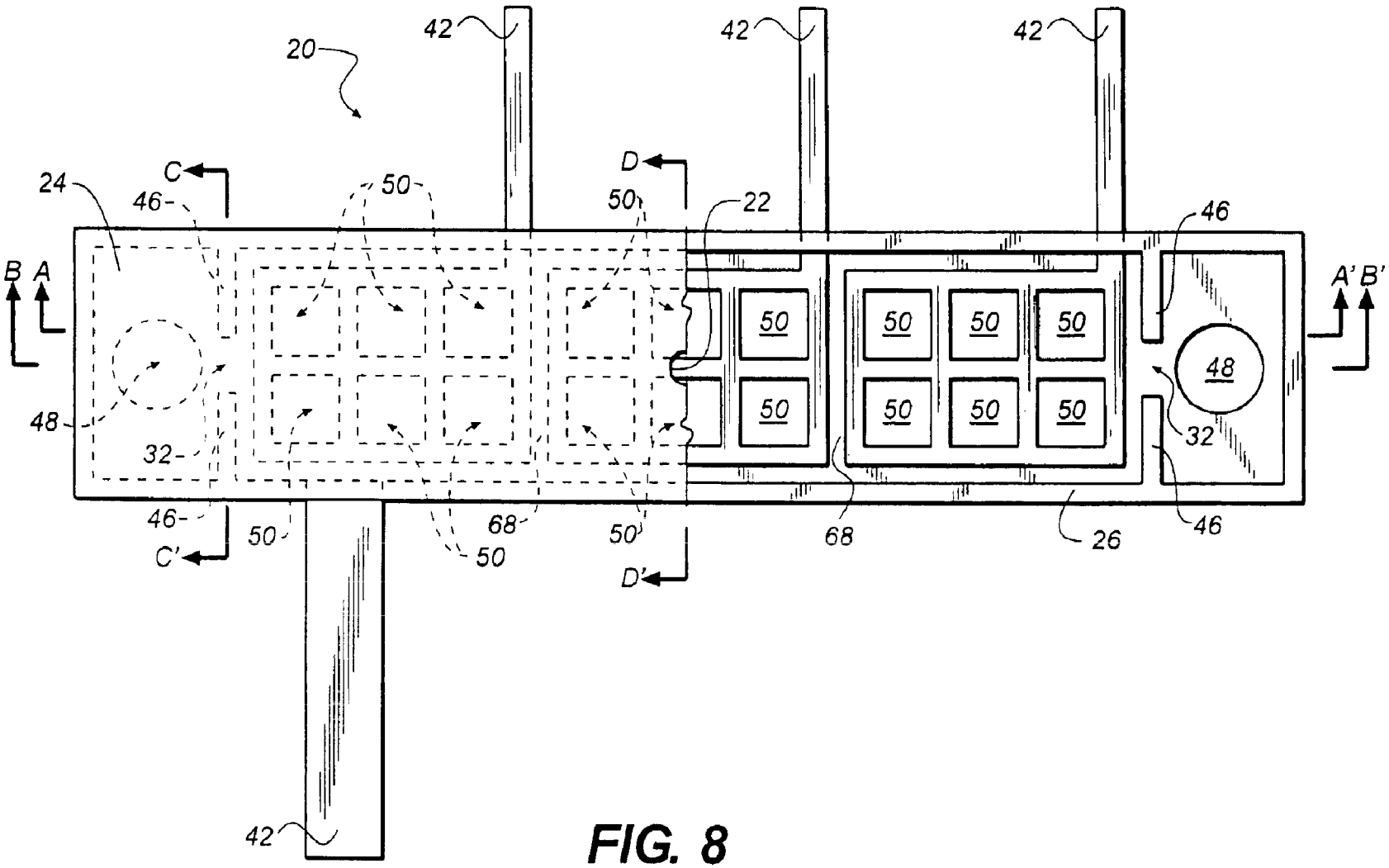
FIG. 8 is a top view of a portion of the drop-on-demand liquid emission device of FIG. 2.

A portion of a first electrode 28 is sealingly attached to outer wall(s) 26 to define a liquid chamber 30 adapted to receive the liquid, such as for example ink, to be ejected from nozzle orifice 22. The liquid is drawn into chamber 30 through one or more refill ports 32, shown in FIG. 8, from a supply, not shown, through a liquid conduit(s) 48. The liquid typically forms a meniscus in the nozzle orifice 22. A flow restrictor(s) 46, shown in FIG. 8, is located at one or both ends of liquid chamber 30, and acts to reduce liquid back flow during ejection. Liquid chamber 30 is typically positioned over at least one structural support 44.

Dielectric fluid, delivered along a fluid path 50, fills a fluid region 34 positioned on a side of first electrode 28 opposite liquid chamber 30. Fluid region 34 is at least partially created during the formation of pedestal(s) 68, described below. The dielectric fluid is preferably air or other dielectric gas, although a dielectric liquid may be used.

Typically, first electrode 28 (deformable membrane, member, etc.) is made of a somewhat flexible conductive material such as titanium aluminide, or, in the preferred embodiment, a combination of layers having a conductive layer positioned over a dielectric layer. For example, a preferred first electrode 28 comprises a thin film of titanium aluminide stacked over a thin film of silicon nitride, each film for example, being one micron thick. In this case, the nitride acts to insulate the titanium aluminide from the second electrode 36 during the first stage of actuation, described below with reference to at least FIGS. 6*a*–6*c*. Additionally, first electrode 28 is preferably at least partially flexible, and is electrically addressable through an electrical lead 42, shown in FIG. 8.

A second electrode 36 is positioned on the side of first electrode 28 opposed to liquid chamber 30, and is electrically addressable separately from first electrode 28. Typically, second electrode 36 is made of a somewhat flexible conductive material such as polysilicon, or, in the preferred embodiment, a combination of layers having a central conductive layer surrounded by an upper and lower insulating layer. For example, a preferred second electrode 36 comprises a thin film of polysilicon stacked between two thin films of silicon dioxide, each film for example, being one micron thick. In the latter case, the oxide acts to insulate the polysilicon from the first electrode 28 during the first stage of actuation. Second electrode 36 is divided into at least two, and preferably more than two, segments individually electrically addressable through electrical leads 42, shown in FIG. 8.

A fluid path 50 is defined by structural supports 44 which provide structural rigidity to the mechanism 20 and serve to anchor the second electrode 36. This helps to prevent second electrode 36 from moving toward first electrode 28 during the first stage of actuation. Both the outer wall(s) 26 and structural supports 44 may either comprise a single layer or comprise a stack of material layers.

At least one pedestal 68 separates first and second electrodes. Pedestal(s) 68 can be electrically insulating, which term is intended to include a pedestal of conductive material but having a non-conductive break therein. Patterning of second electrode 36 defines each individually addressable segment(s) of second electrode 36. Pedestal(s) 68 are preferably located between the segments of second electrode 36. However, pedestal(s) 68 can be located at various locations over a segment(s) of second electrode 36 depending on the desired application of the mechanism 20. The location of each pedestal 68 also defines each individual portion of the first electrode 28 (deformable membrane, member, etc.) that corresponds to and interacts with each individually addressable segment(s) of second electrode 36.

Figure 32:
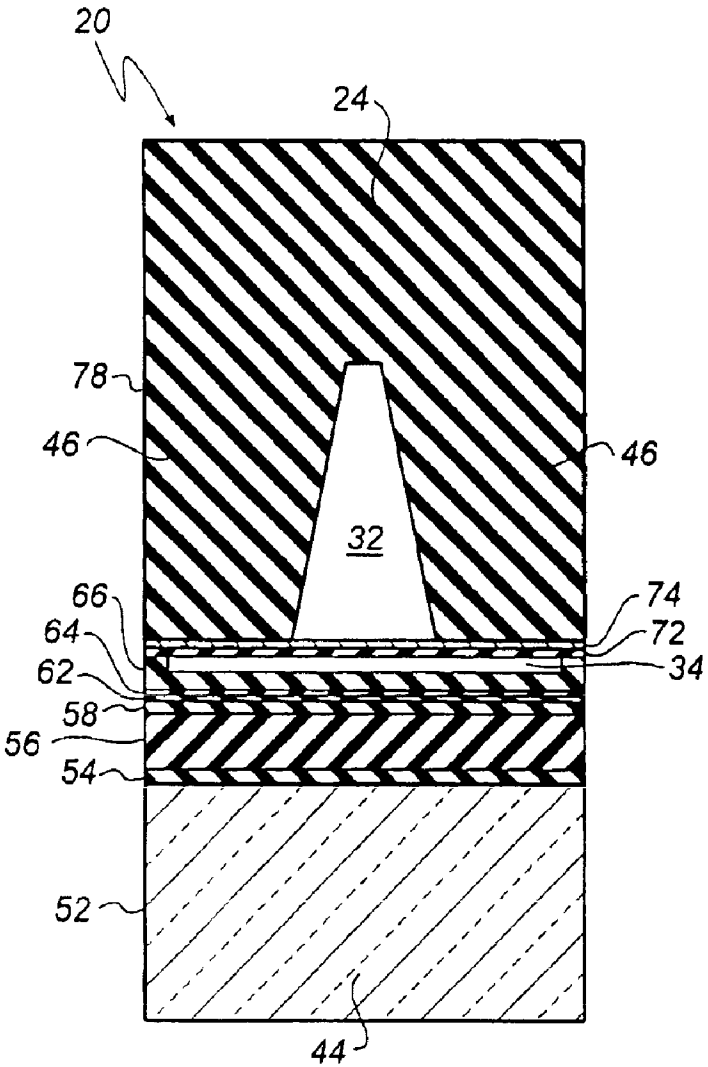
FIG. 32 shows a cross-section through line C–C' of FIG. 8.

A flow restrictor 46, shown in FIGS. 8 and 32, restricts the return of fluid from liquid chamber 30 to the fluid reservoir. The fluid path 50 allows the dielectric fluid in fluid region 34 to flow into and out of a dielectric fluid reservoir (not shown). In the preferred embodiment, the dielectric fluid is air, and the ambient atmosphere performs the function of a dielectric fluid reservoir.

Figure 3:
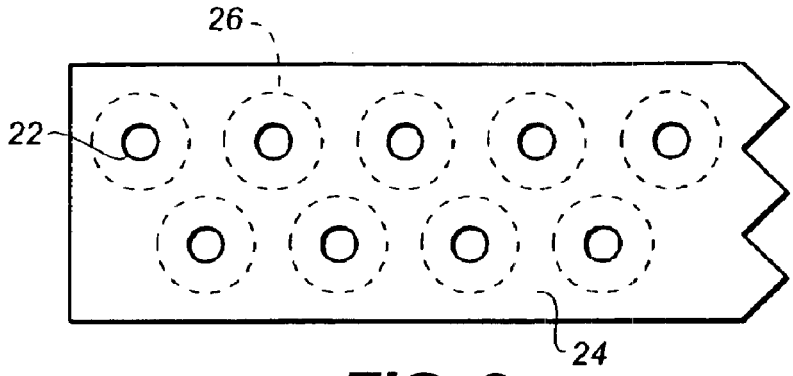
FIGS. 3–5 are top plan views of alternative embodiments of a nozzle plate of the drop-on-demand liquid emission device of FIGS. 1 and 2.
Figure 4:
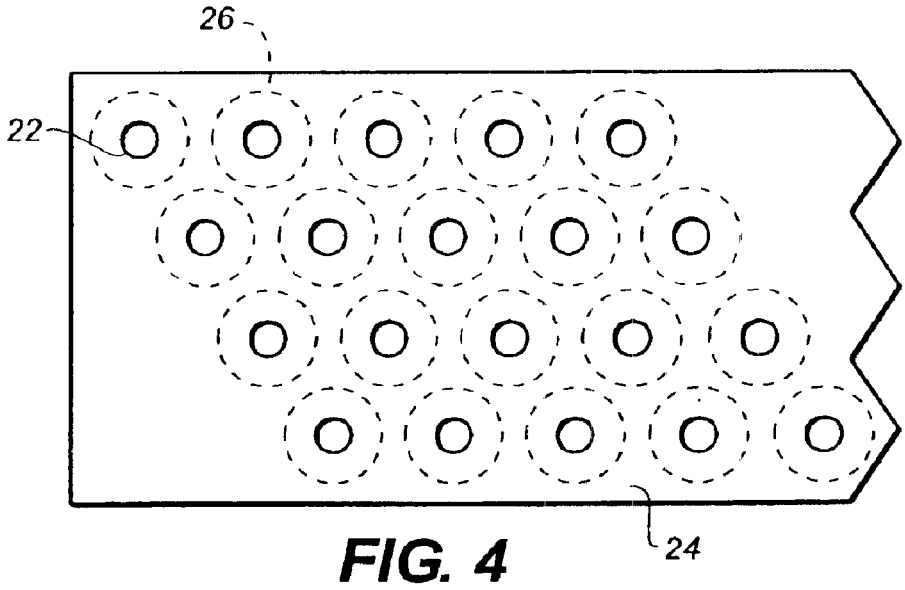
Figure 5:
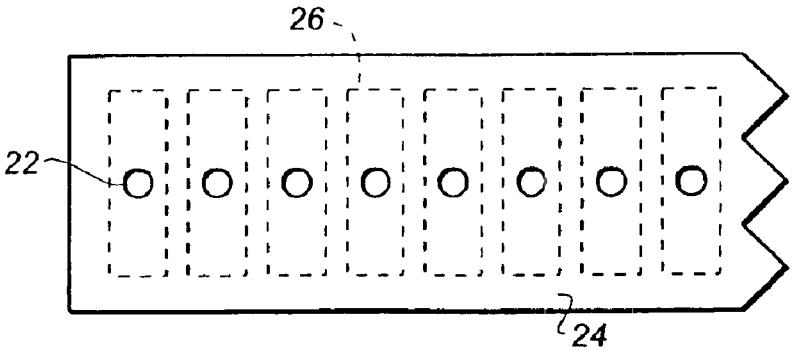

FIGS. 3–5 are top plan views of nozzle plate 24, showing several alternative embodiments of layout patterns for the several nozzle orifices 22 of a nozzle plate 24. Note that in FIGS. 3 and 4, the interior surface of walls 26 are annular, while in FIG. 5, walls 26 form rectangular chambers. Other shapes are of course possible, and these drawings are merely intended to convey the understanding that alternatives are possible within the spirit and scope of the present invention.

Figure 6A:
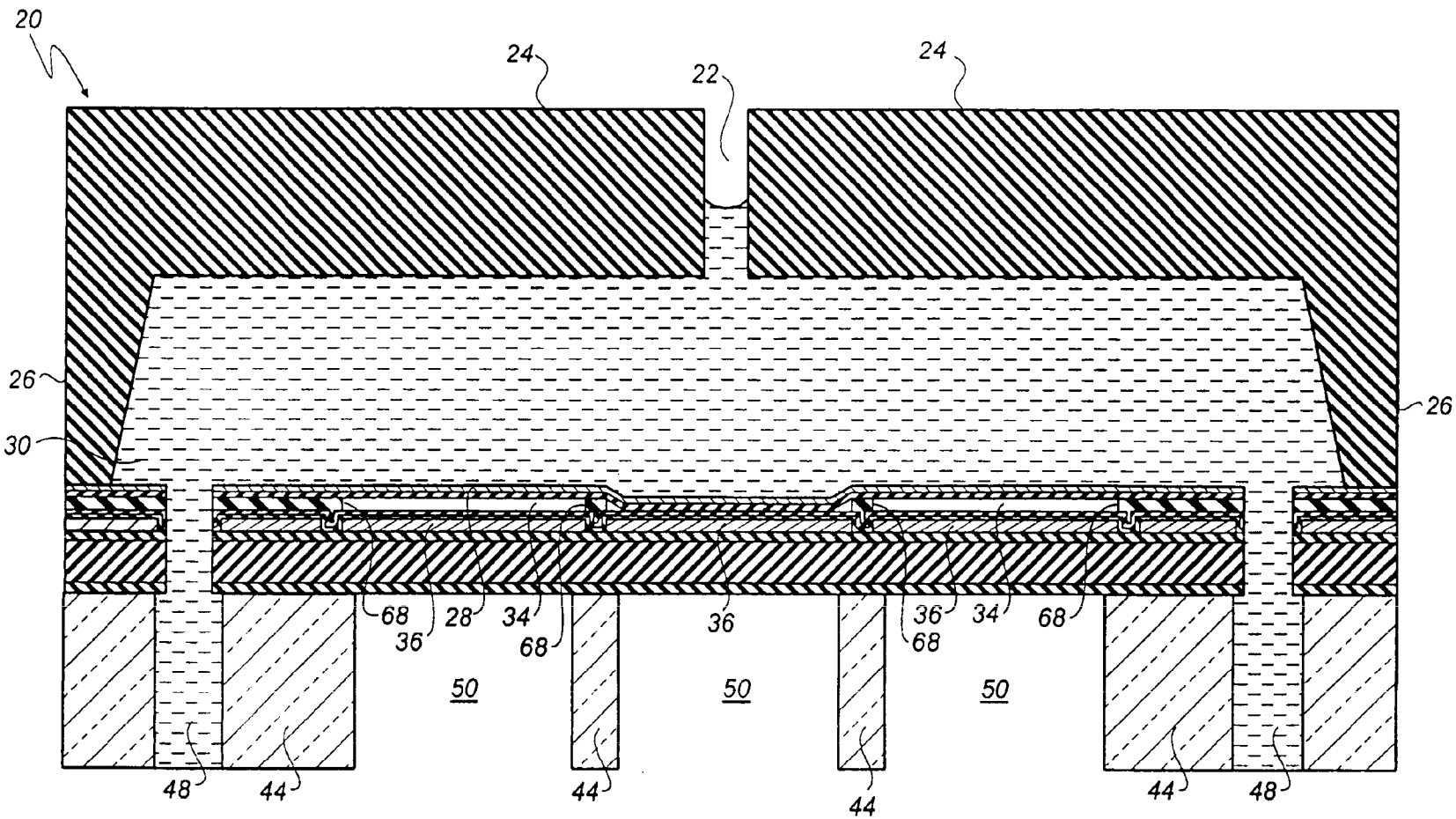
FIGS. 6*a*–6*c* are cross-sectional views of the drop-on-demand liquid emission device of FIG. 2 shown in a first actuation stage.
Figure 6B:
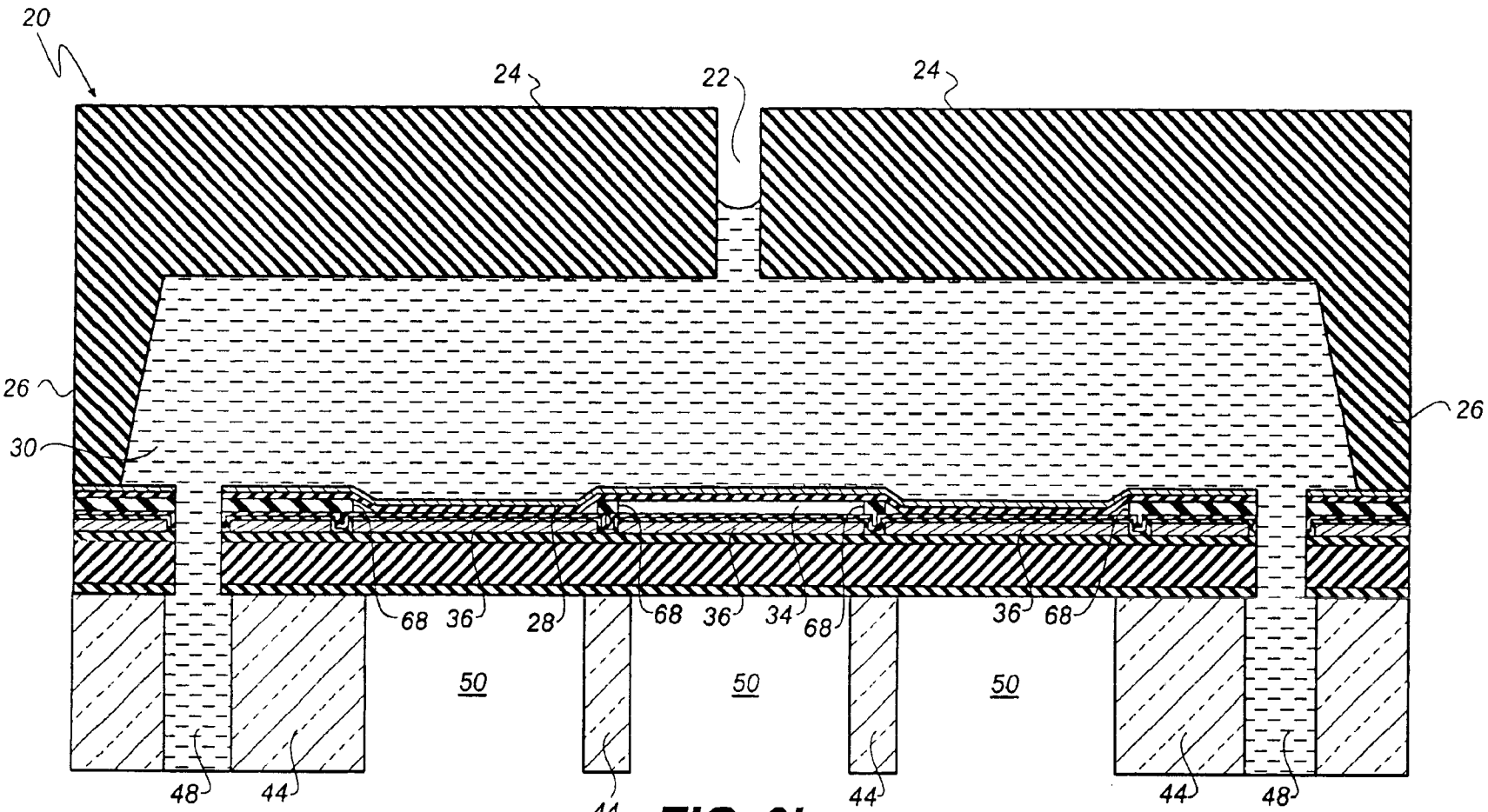
Figure 6C:
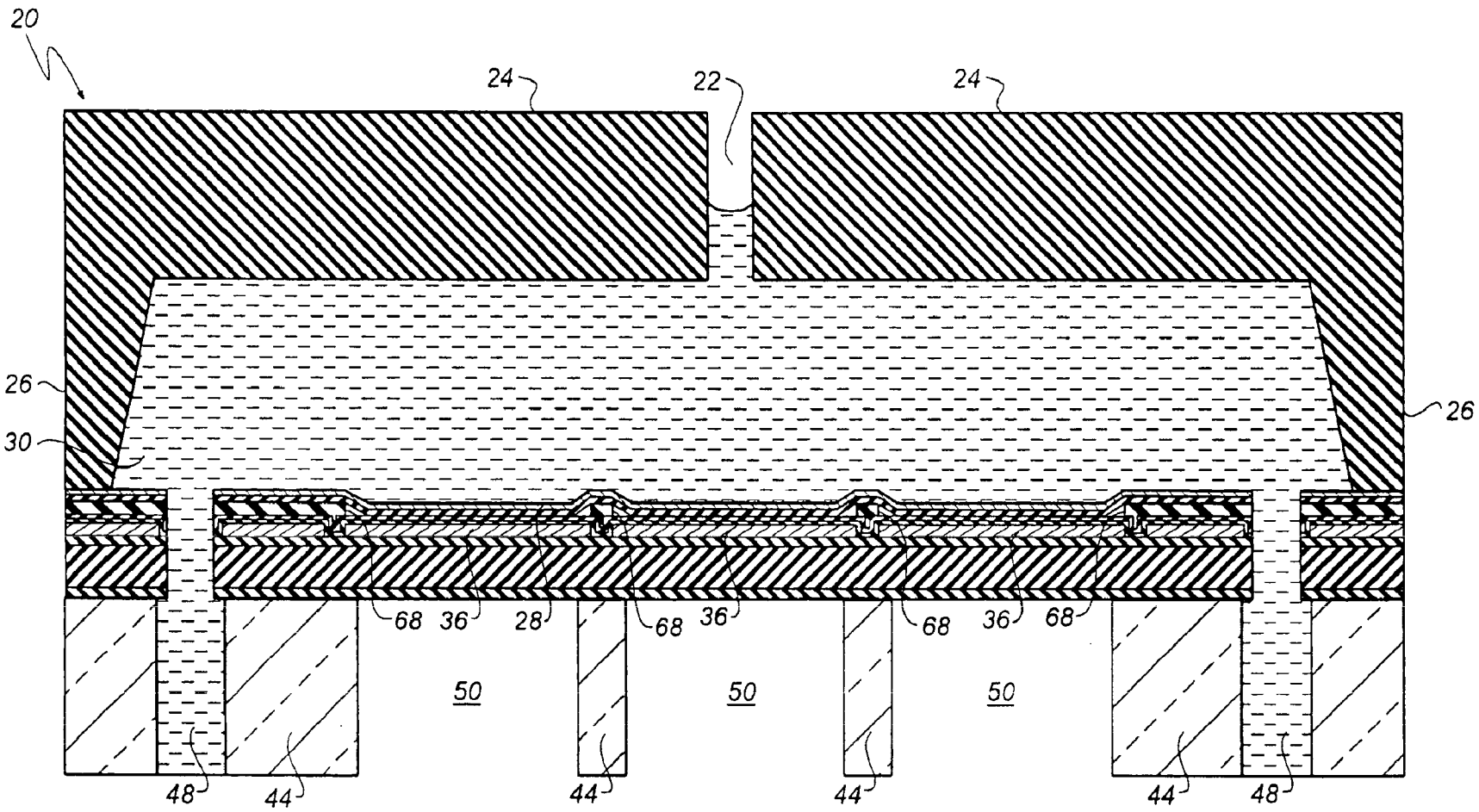

Referring to FIGS. 6*a*–6*c*, to eject a drop, a voltage difference is applied between the conductive portion of addressable first electrode 28 and at least one of the segments of the conductive portion of second electrode 36. Typically, this is accomplished by energizing at least one segment of addressable second electrode 36 while maintaining addressable first electrode 28 at ground. In this manner, liquid in chamber 30 is not subjected to an electrical field. As shown in FIGS. 6*a*–6*c*, at least a portion of addressable first electrode 28 is attracted to the energized segment(s) of second electrode 36 until it is deformed to substantially the surface shape of the second electrode 36, except in the region very near to the pedestal(s) 68. Since addressable first electrode 28 forms a wall portion of liquid chamber 30 behind the nozzle orifice 22, movement of first electrode 28 away from nozzle plate 24 expands the chamber, drawing liquid into the expanding chamber through refill ports 32.

In FIG. 6*a*, only the portion of first electrode 28 located opposite nozzle orifice 22 has been deformed toward the corresponding energized segment of second electrode 36. In FIG. 6*b*, the portions of first electrode 28 peripherally located opposite nozzle orifice 22 have been deformed toward the corresponding energized segments of second electrode 36. In FIG. 6*c*, all three portions of first electrode 28 have been deformed toward the corresponding energized segments of second electrode 36. FIGS. 6*a*–6*c* are provided to illustrate various ways of actuating first electrode 28. In other embodiments, more or fewer segments of second electrode 36 can be provided and energized. Additionally, different combinations of segments of second electrode 36 can be energized. Doing this will vary how first electrode 28 portion(s) is actuated or deformed to its second position.

Figure 7A:
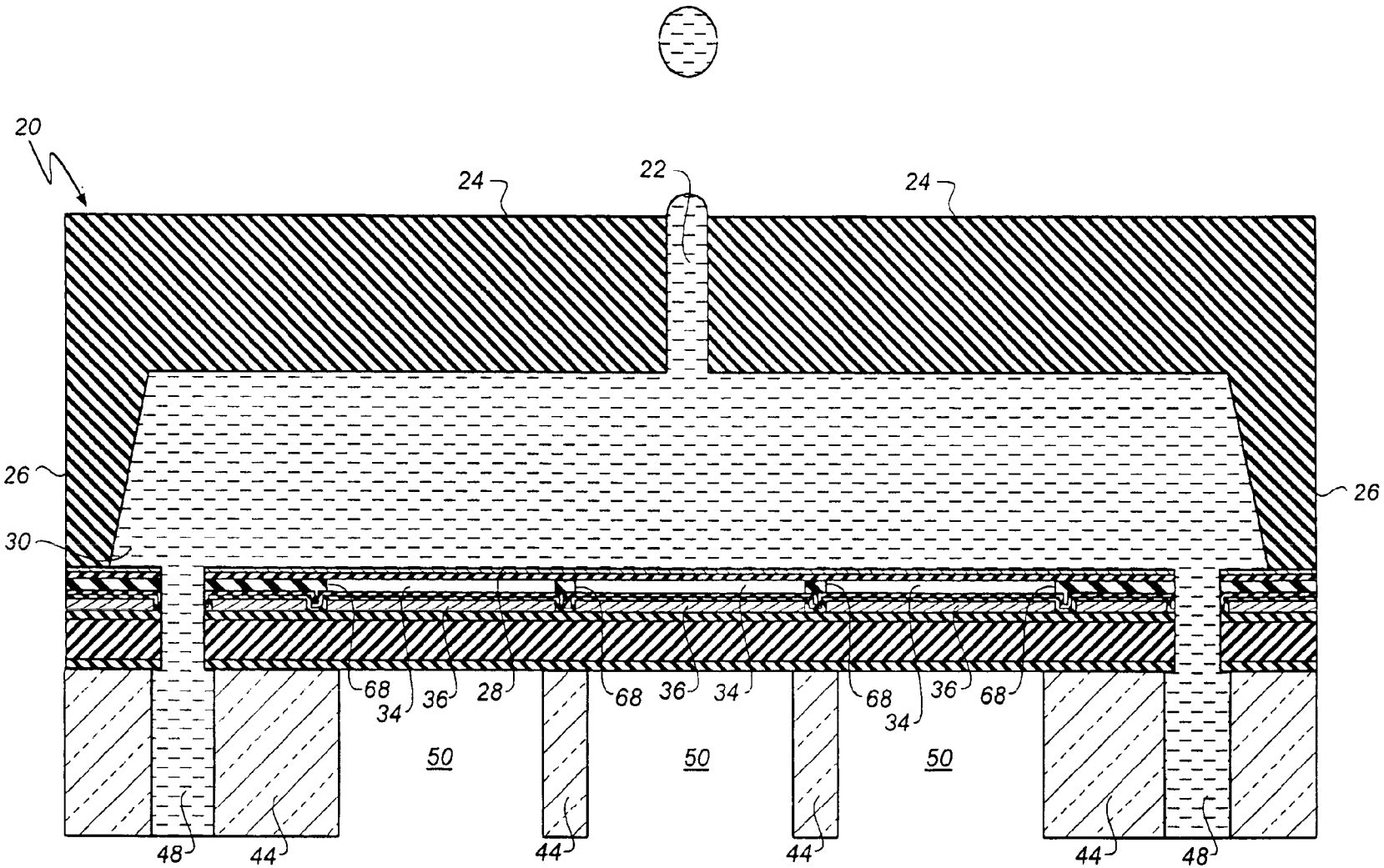
FIGS. 7*a*–7*c* are cross-sectional views of the drop-on-demand liquid emission device of FIG. 2 shown in a second actuation stage.
Figure 7B:
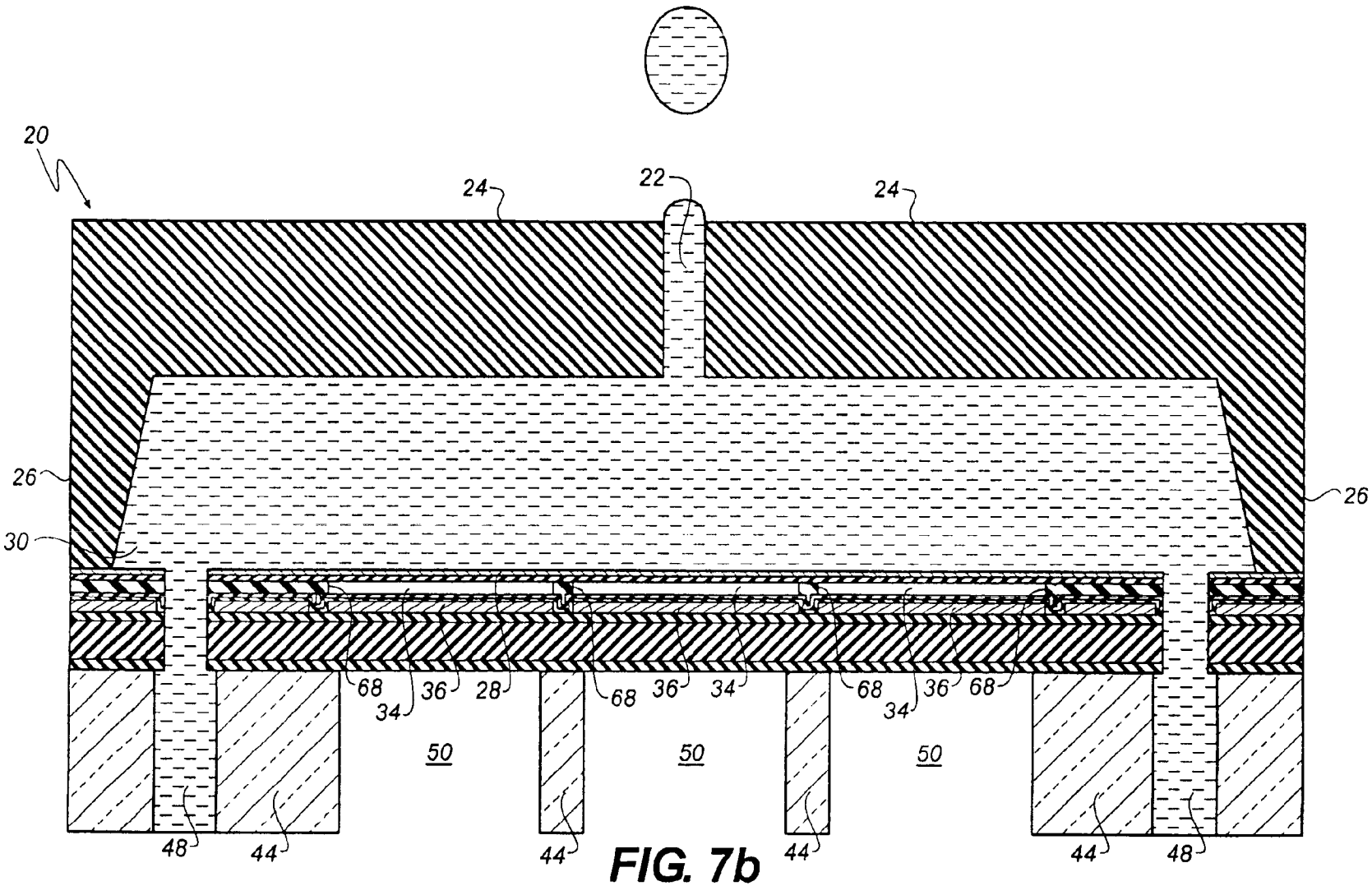
Figure 7C:
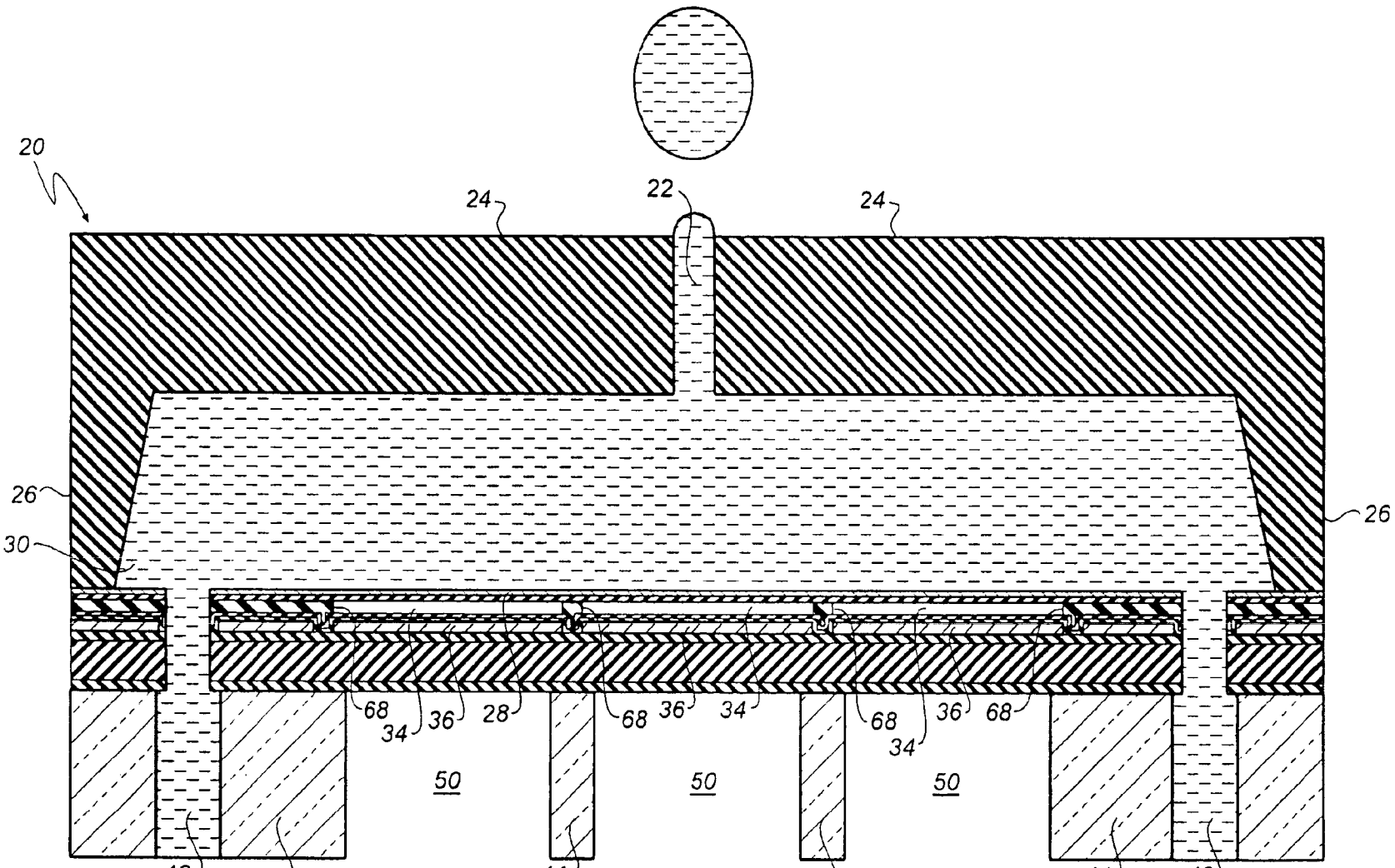

Referring to FIGS. 7*a*–7*c*, subsequently (say, several microseconds later), the segment(s) of addressable second electrode 36 is de-energized, that is, the potential difference between electrodes 36 and 28 is made zero, causing the portion of addressable first electrode 28 to return to its first position. This action pressurizes the liquid in chamber 30 behind the nozzle orifice 22, causing a drop to be ejected from the nozzle orifice. To optimize both refill and drop ejection, refill ports 32 should be properly sized to present sufficiently low flow resistance so that filling of chamber 30 is not significantly impeded when electrode 28 is energized, and yet present sufficiently high resistance to the back flow of liquid through the refill port 32 during drop ejection. FIGS. 7*a*–7*c* also illustrate how the size of the ejected drop varies depending on the number of segments of second electrode 36 energized (and corresponding portions of first electrode 28 deformed) in FIGS. 6*a*–6*c*.

FIG. 8 is a schematic top view of a portion of drop ejection mechanism 20 of FIG. 2. In FIG. 8, nozzle plate 24, wall(s) 26, and first electrode 28 have been removed exposing electrical lead lines 42, pedestal(s) 68, addressable second electrode 36, and at least a portion of fluid region 34. Nozzle orifice 22 remains to illustrate relative locations of these elements with respect to the nozzle orifice of the preferred embodiment.

Still referring to FIG. 8, during operation, electrical signals are sent via electrical leads 42 to the first and second electrodes 28 and 36 of FIG. 2. Each segment(s) of second electrode 36 is provided with its own lead line 42 (represented by the three smaller lead lines 42 in FIG. 8) while first electrode 28 is provided with a single lead line 42 (represented by the larger lead line 42 in FIG. 8). Fabricating the device in this manner helps to keep the liquid in chamber 30 isolated from any electric field during operation. However, in situations where this is not a concern, the first electrode 28 can be segmented with each segment having its own lead line 42 while second electrode 36 has a common lead line 42. In this situation, during operation, the appropriate segment(s) of first electrode is energized while second electrode 36 is maintained at ground.

A line A–A' in FIG. 8 indicates the plane of the cross-sections depicted in FIGS. 9–30 which illustrate a single liquid emission device. Typically, many of these devices would be batch fabricated simultaneously.

Figure 9:
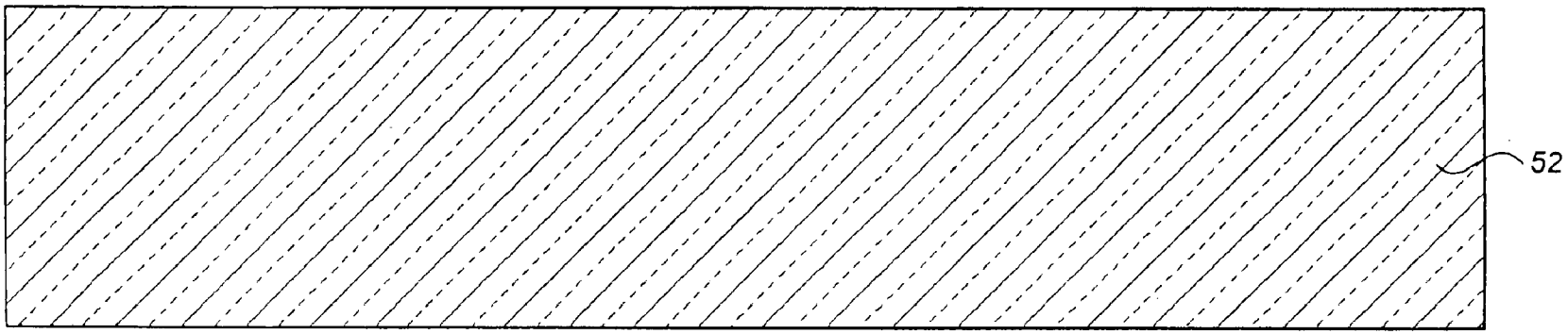
FIGS. 9–30 are cross-sectional views through line A–A' of FIG. 8 showing a sequence of fabrication of the liquid emission device of FIG. 2.

FIG. 9 shows a substrate 52 of, say, a 675 $\mu$m thick, single crystal silicon wafer, for example. Substrate 52 supports the electrode structure; helps form liquid conduits 48 that bring liquid to chamber 30; and forms fluid path(s) 50 that bring the dielectric fluid to fluid region 34.

Figure 10:
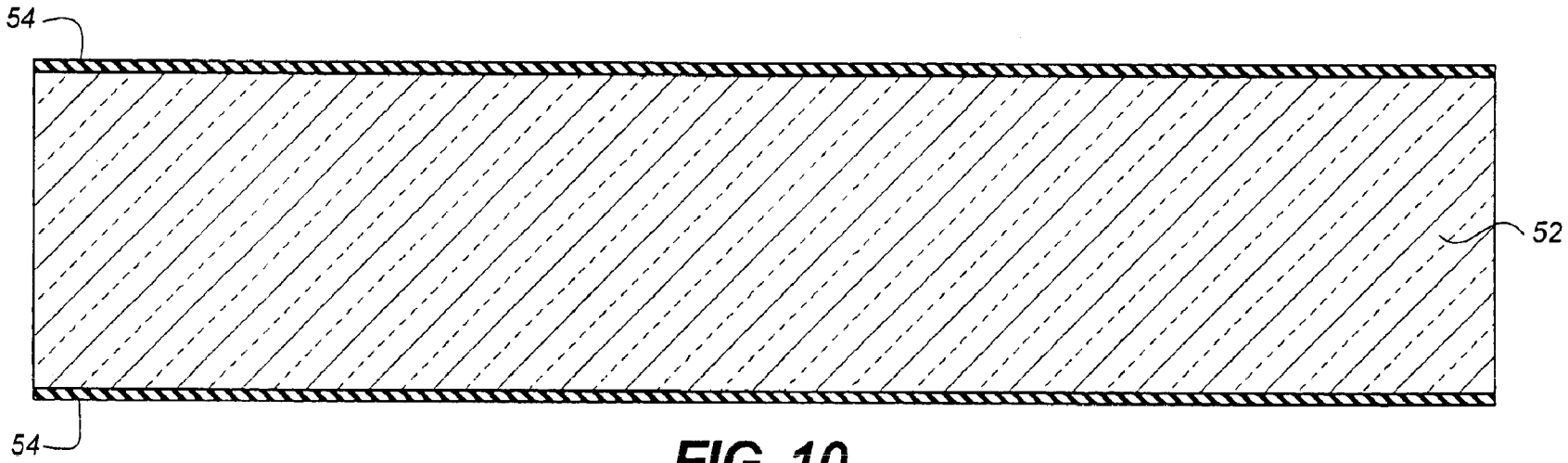
Figure 11:
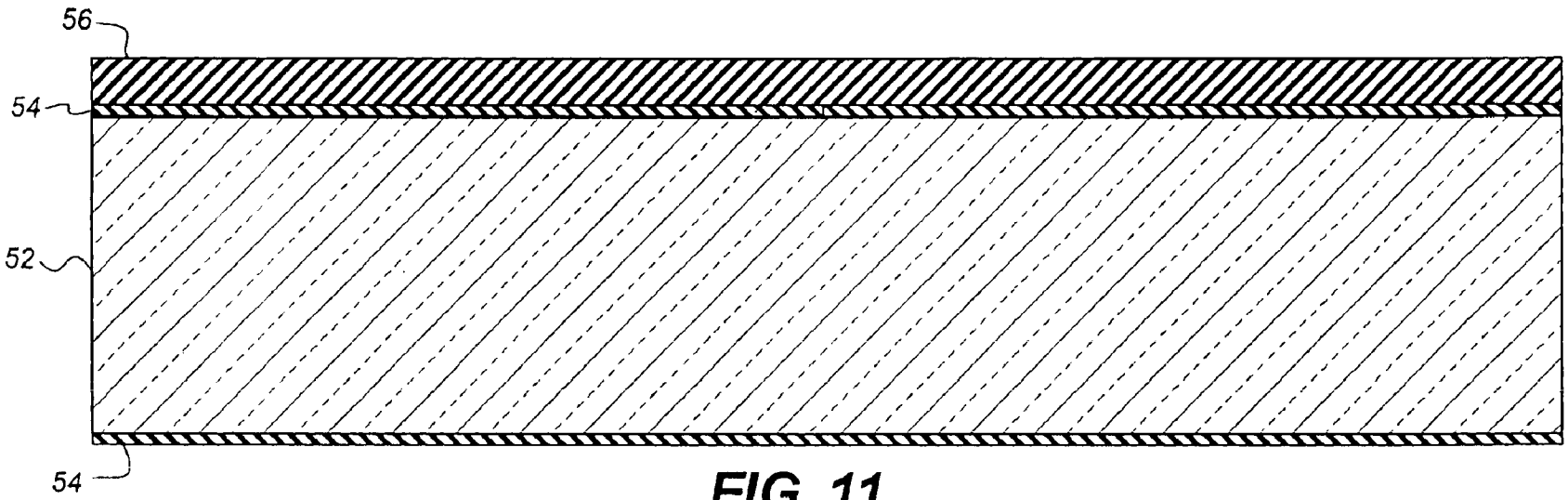

FIG. 10 shows the preferred embodiment after deposition of a first dielectric layer 54 (e.g. 0.35 $\mu$m thermally grown silicon dioxide) on substrate 52. FIG. 11 shows the preferred embodiment after deposition of a second dielectric layer 56 (e.g. 1.2 $\mu$m low-stress silicon nitride) over first dielectric layer 54. Second dielectric layer 56 can be deposited, for example, using plasma enhanced chemical vapor deposition (PECVD).

Figure 12:
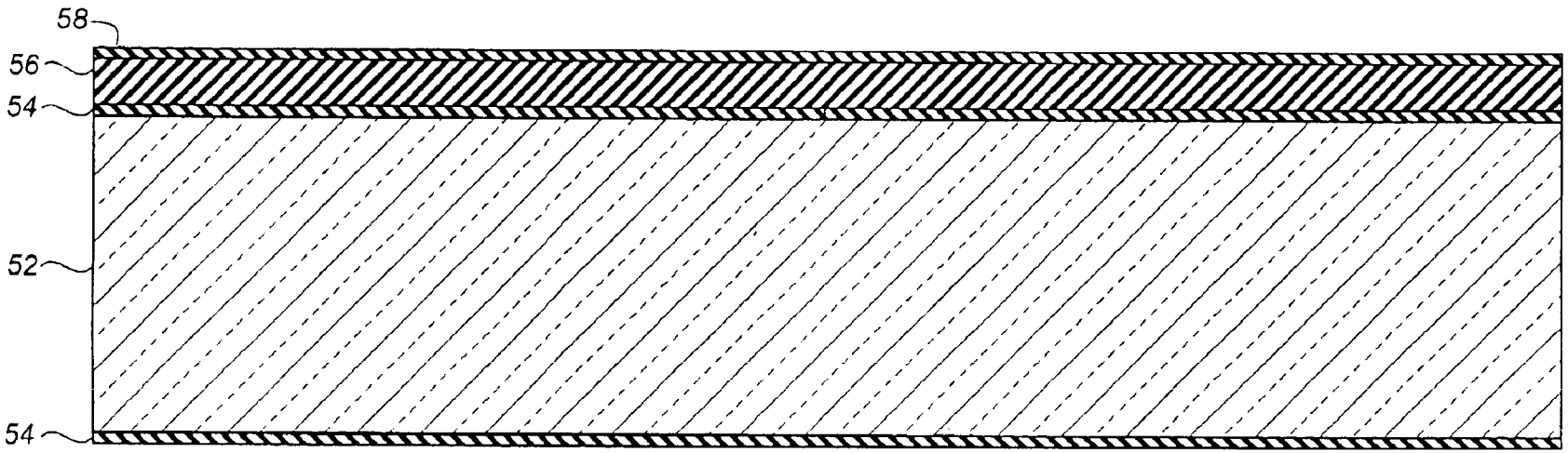
Figure 13:
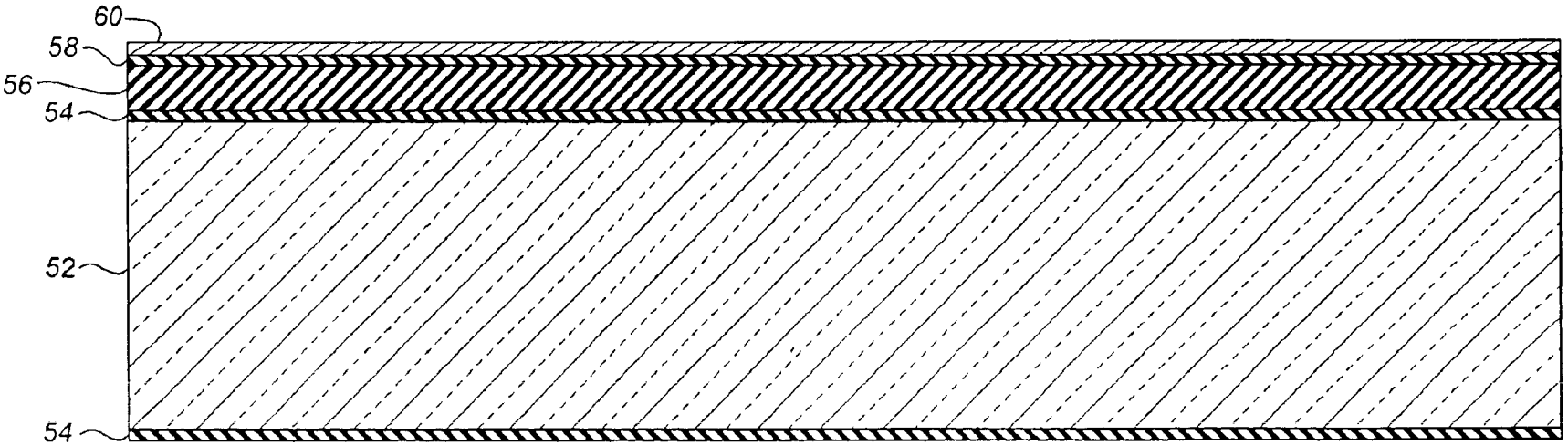

FIG. 12 shows the preferred embodiment after deposition of a third dielectric layer 58 (e.g. 0.2 $\mu$m PECVD silicon dioxide) over second dielectric layer 56. FIG. 13 shows the preferred embodiment after deposition of a first conductive layer 60 (e.g. 0.35 $\mu$m doped polysilicon) over third dielectric layer 58. The first conductive layer 60 acts as the second electrode 36.

Figure 14:
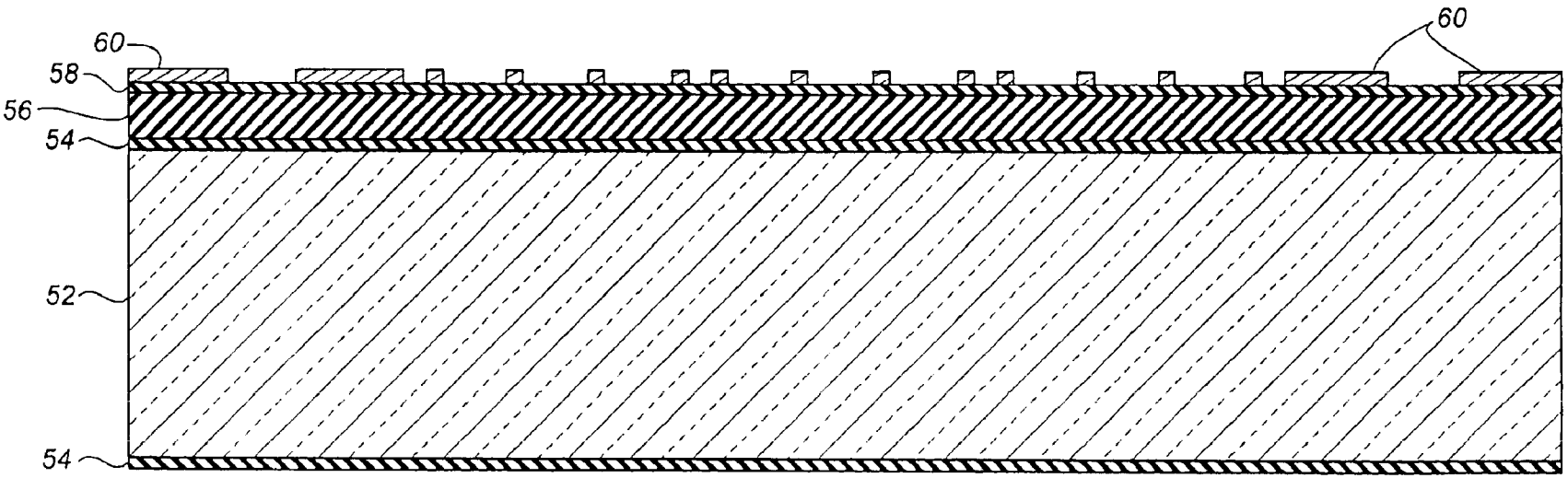
Figure 15:
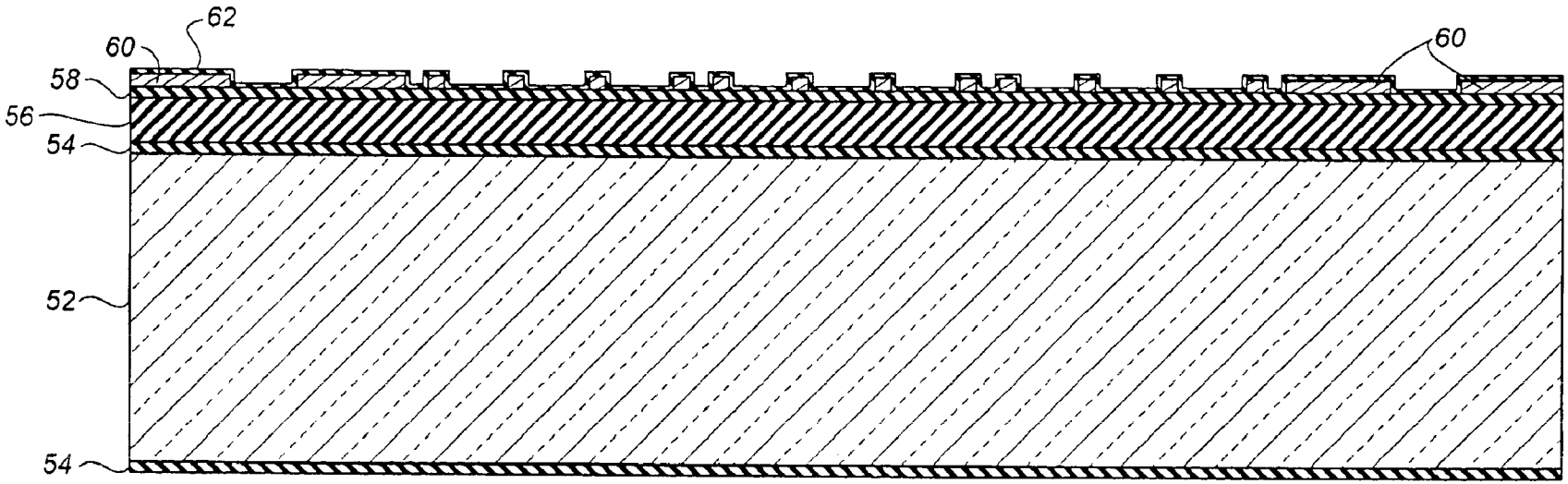

FIG. 14 shows the preferred embodiment after patterning and etching the first conductive layer 60. Individual segments of the second electrode 36 are defined during this step, as are the electrical leads 42 that convey power to the individual segments of the second electrode 36. Fluid conduits 48 are also defined during this step of the fabrication process. FIG. 15 shows the preferred embodiment after deposition of the fourth dielectric layer 62 (e.g. 0.02 $\mu$m thermally grown silicon dioxide) over the first conductive layer 60. The third dielectric layer 58 and the fourth dielectric layer 62 provide electrical isolation for the first conductive layer 60.

Figure 16:
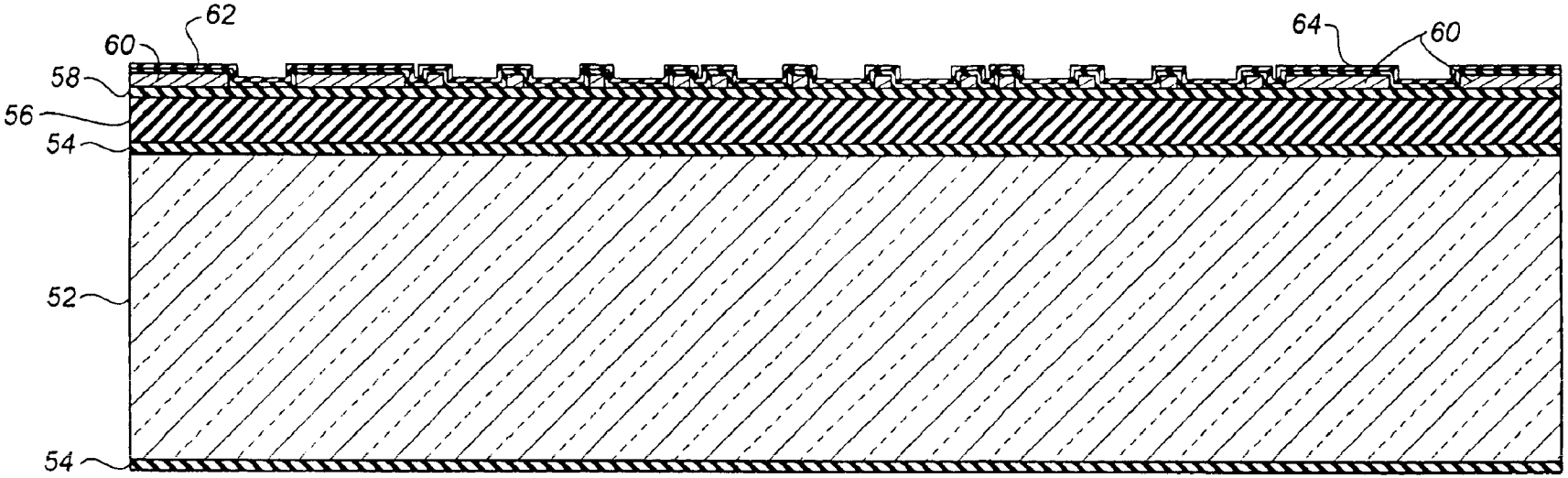
Figure 17:
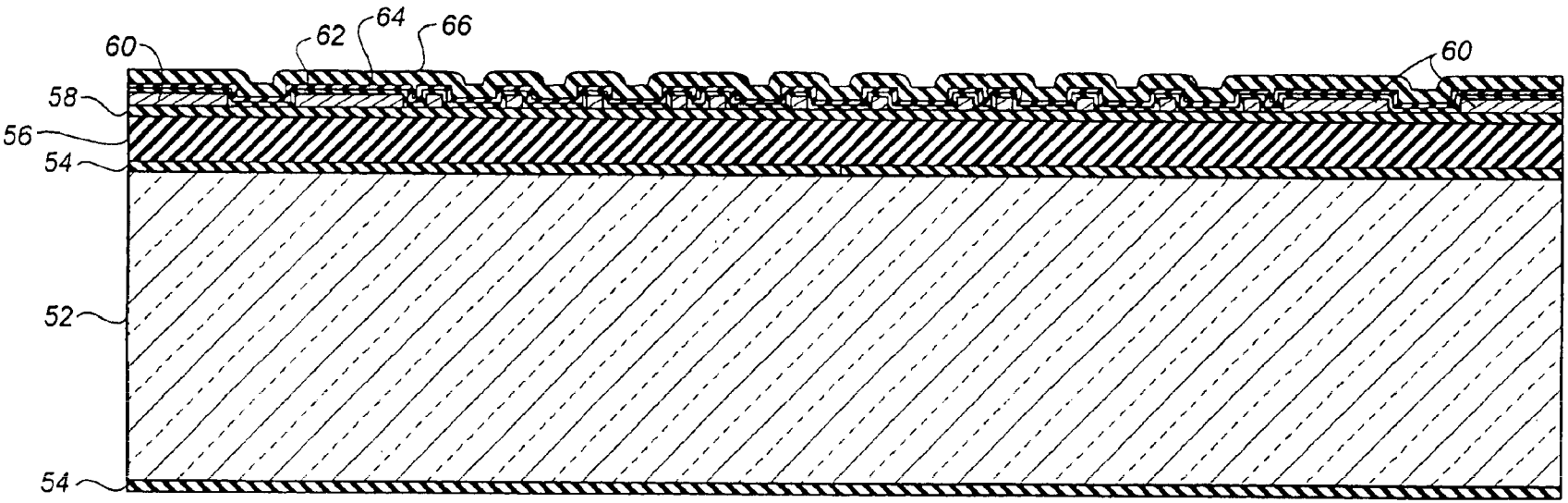

FIG. 16 shows the preferred embodiment after deposition of the fifth dielectric layer 64 (e.g. 0.02 $\mu$m PECVD silicon nitride) over the fourth dielectric layer 62. FIG. 17 shows the preferred embodiment after deposition of the sixth dielectric layer 66 (e.g. 0.16 $\mu$m silicon dioxide) over the fifth dielectric layer 64. Sixth dielectric layer 66 forms pedestals 68 that are preferably located between individually addressable segments of the second electrode 36; define the portions of first electrode 28 that are correspondingly deformed toward the second electrode 36 segment(s); and acts as a stop layer for planarization of a future sacrificial layer.

Figure 18:
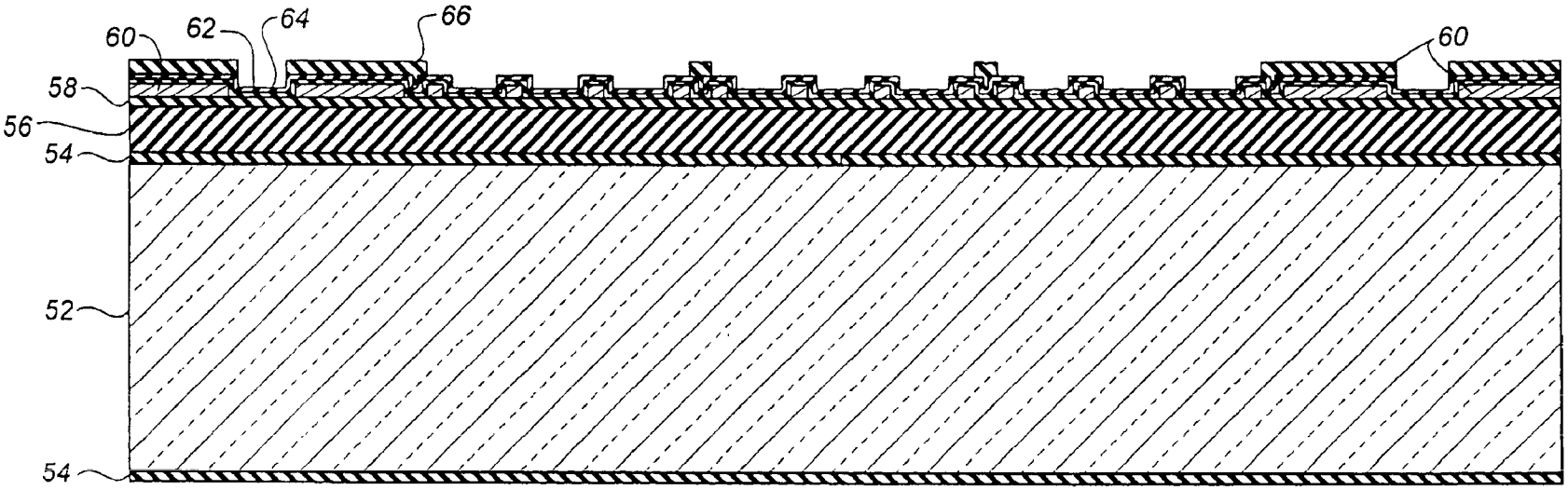

FIG. 18 shows the preferred embodiment after patterning and etching the sixth dielectric layer 66. This step defines fluid path 50; creates pedestals 68; and prevents liquid conduits 48 from becoming obstructed.

Figure 19:
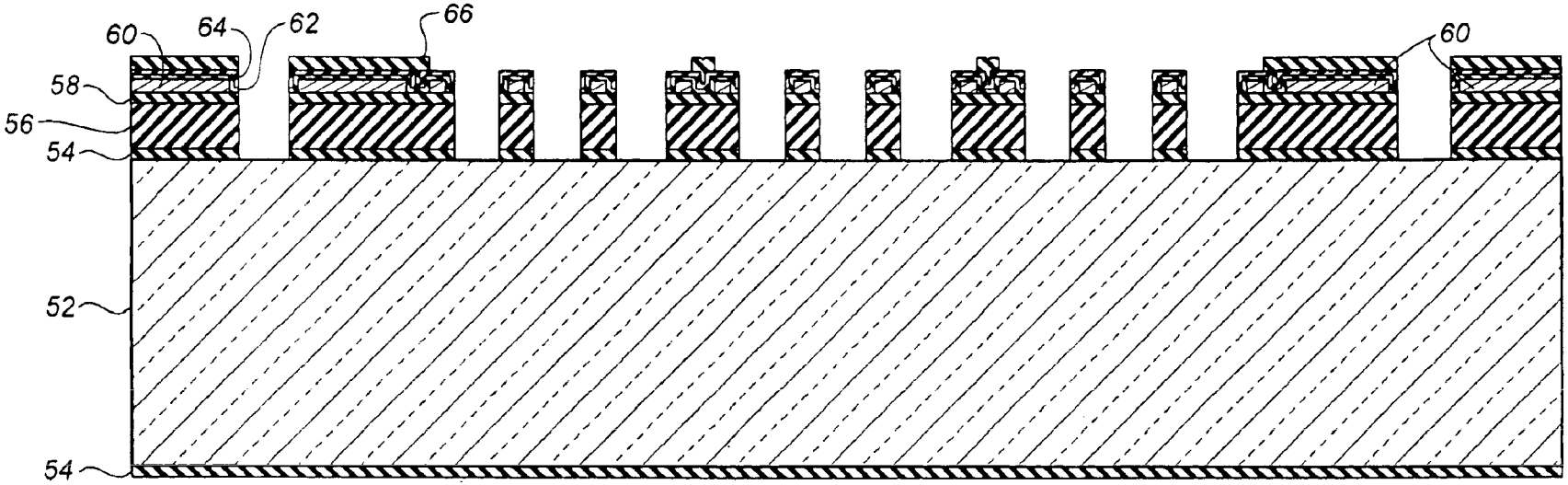

FIG. 19 shows the preferred embodiment after patterning and etching the first dielectric layer 54, the second dielectric layer 56, the third dielectric layer 58, the fourth dielectric layer 62, and the fifth dielectric layer 64. This etch removes material from liquid conduits 48 and the fluid paths 50.

Figure 20:
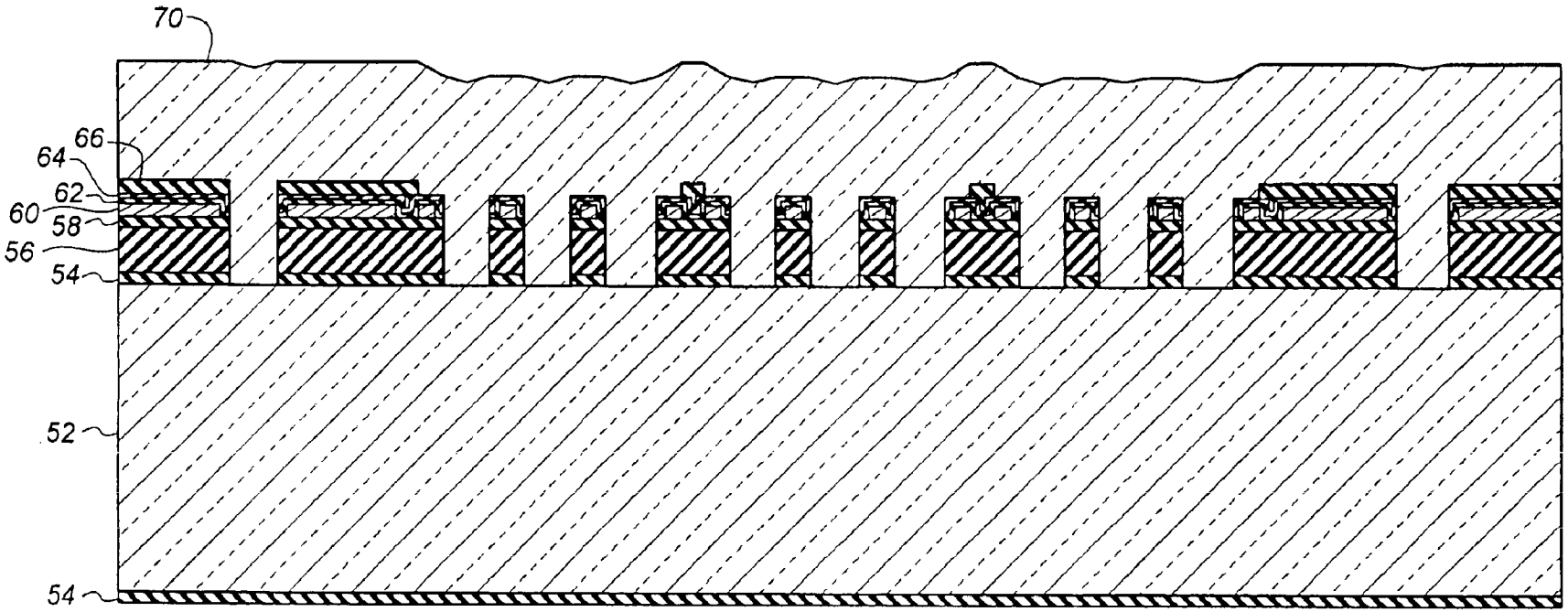
Figure 21:
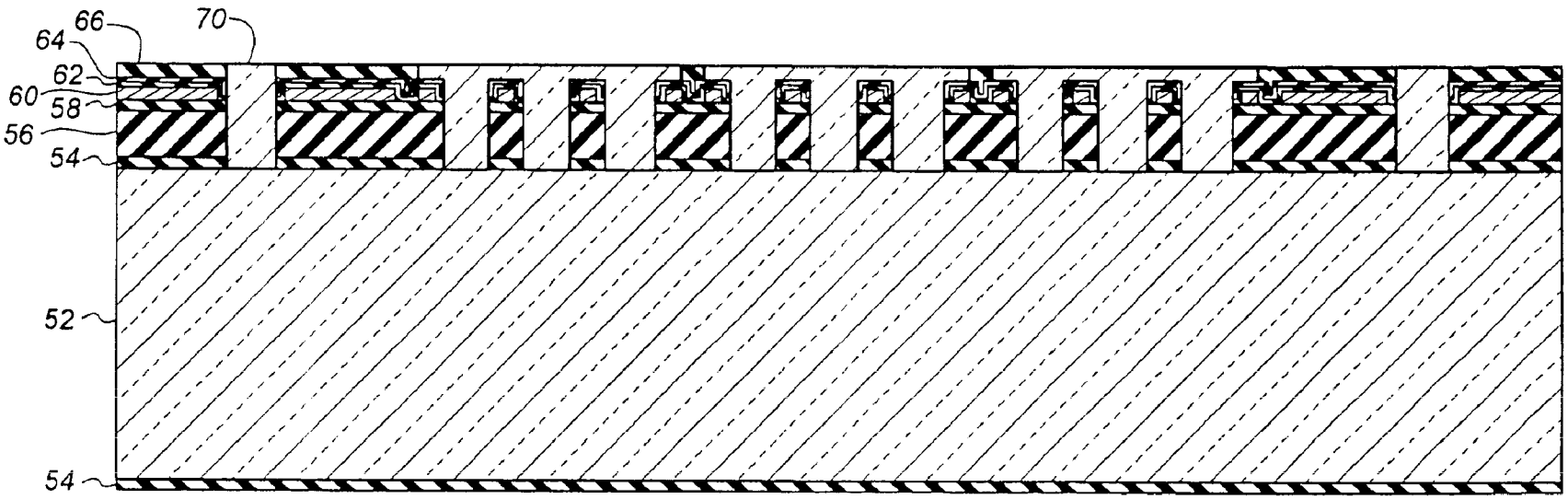

FIG. 20 shows the preferred embodiment after deposition of a first sacrificial layer 70 (e.g. 3 $\mu$m polysilicon). The removal of first sacrificial layer 70 forms fluid region 34. FIG. 21 shows the preferred embodiment after planarization of the first sacrificial layer 70, down to the sixth dielectric layer 66. This provides a flat surface for the subsequent deposition of the first electrode 28.

Figure 22:
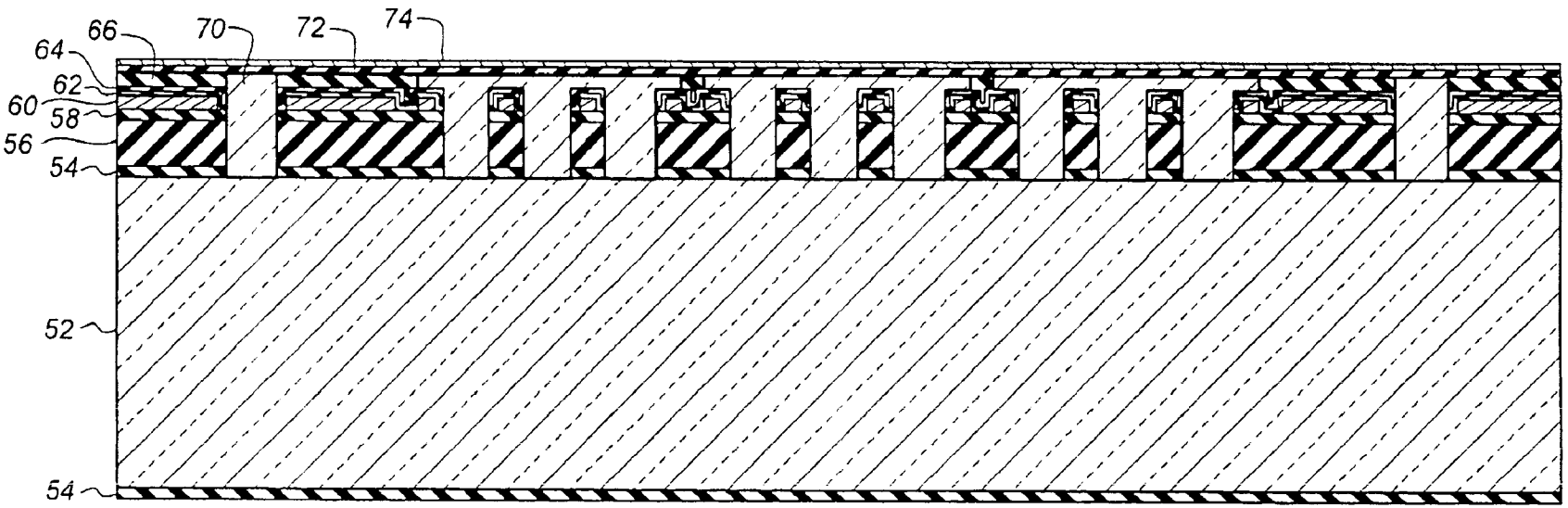
Figure 23:
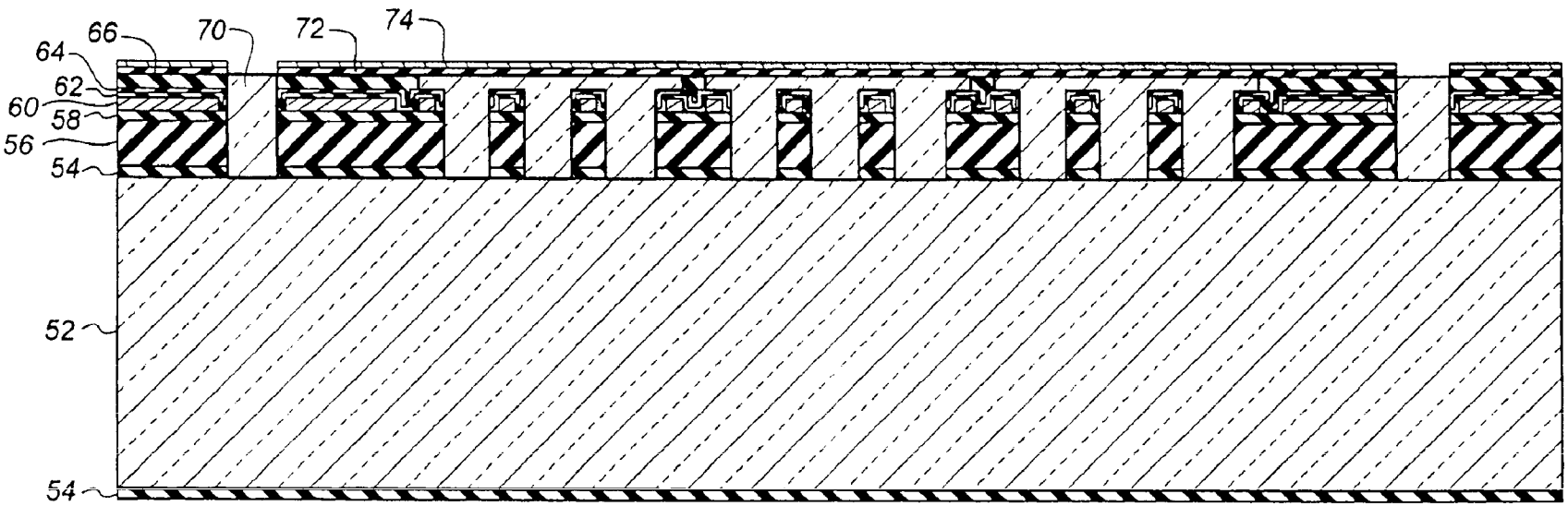

FIG. 22 shows the preferred embodiment after deposition of the seventh dielectric layer 72 (e.g. 0.1 $\mu$m silicon nitride) and the second conductive layer 74 (e.g. 0.07 $\mu$m titanium aluminide). Second conductive layer 74 is typically comprised of a material that is not attacked by the liquid contained in liquid chamber 30. These two layers form first electrode 28 (deformable membrane, member, etc.). FIG. 23 shows the preferred embodiment after patterning and etching of the seventh dielectric layer 72 and the second conductive layer 74. Again, liquid conduits 48 remain obstruction free.

Figure 24:
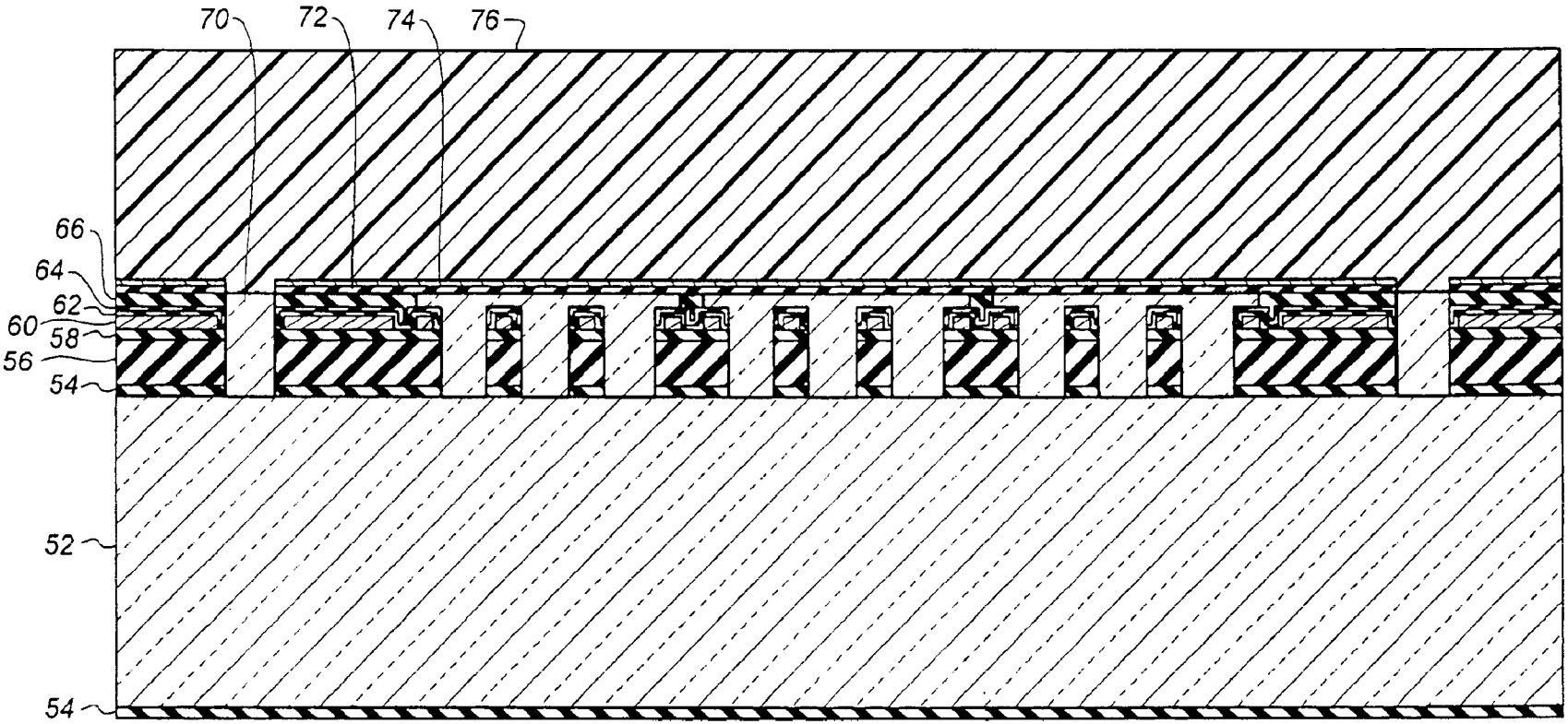
Figure 25:
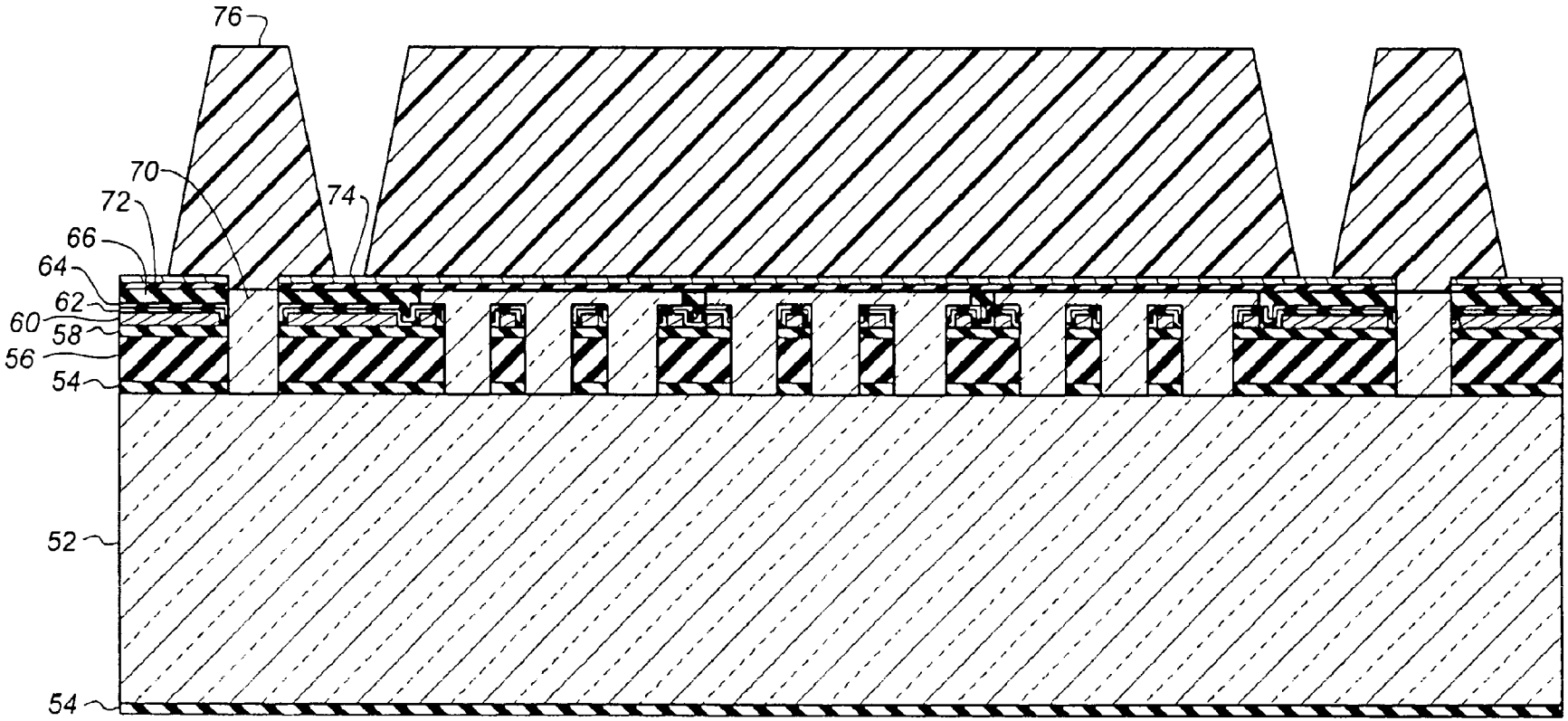
Figure 26:
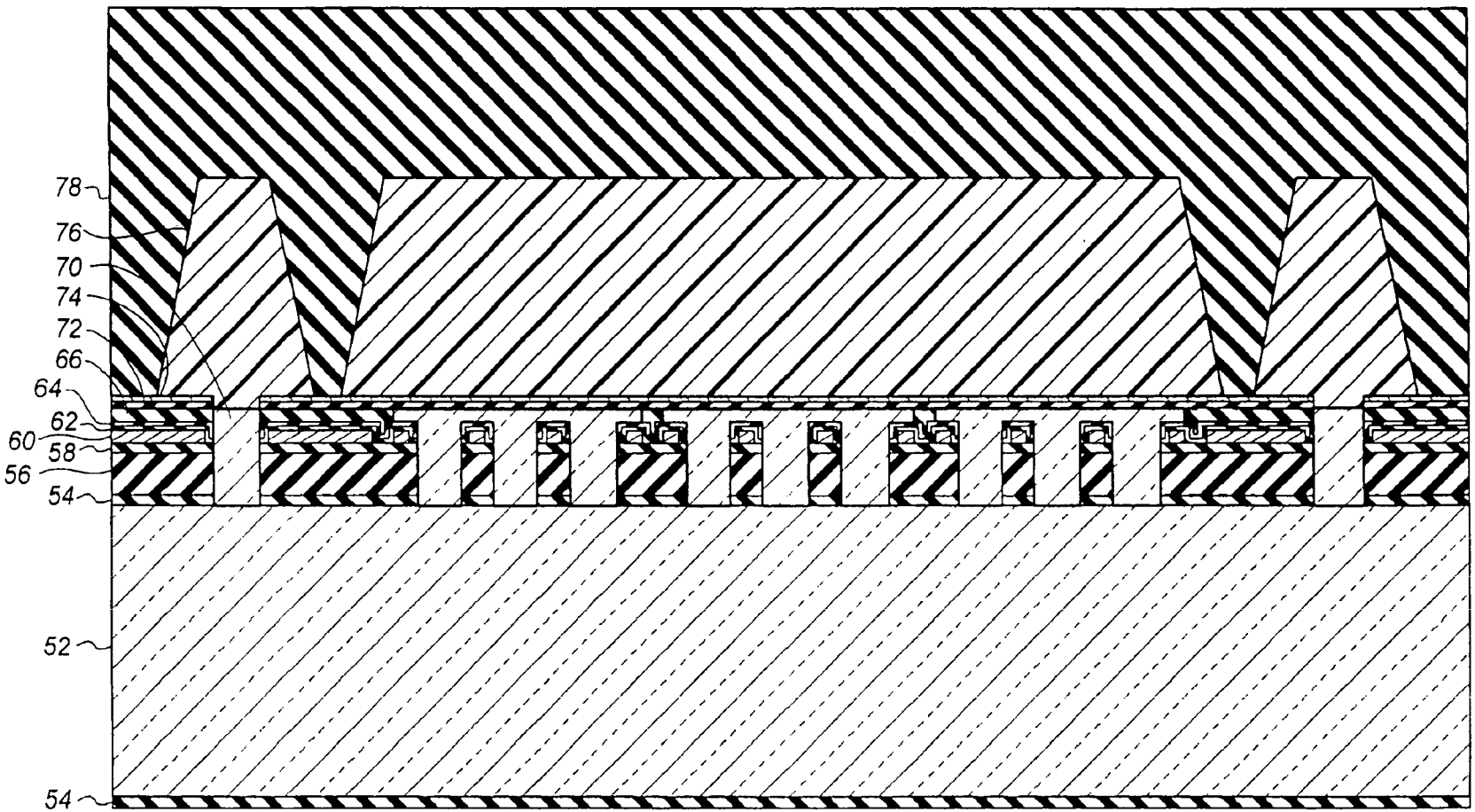
Figure 27:
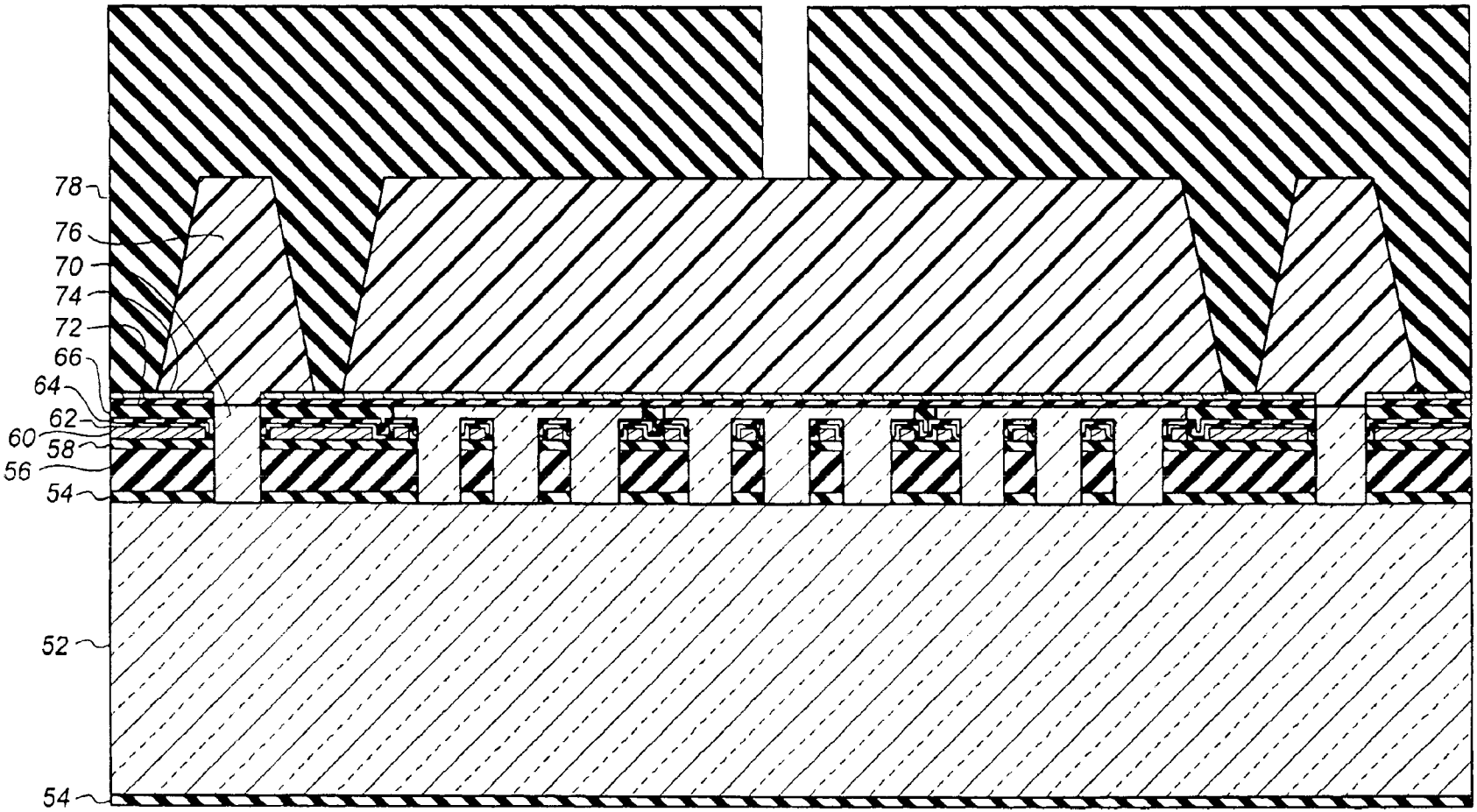

FIG. 24 shows the preferred embodiment after deposition of a second sacrificial layer 76 (e.g. 5 $\mu$m polyimide). FIG. 25 shows the preferred embodiment after patterning of the second sacrificial layer 76 (e.g. by UV exposure of a photosensitive polyimide). This defines the wall(s) and top of liquid chamber 30. This patterning process can result in the sloped sidewalls shown in FIG. 25. FIG. 26 shows the preferred embodiment after deposition of an eighth dielectric layer 78 (e.g. 8 um oxynitride). This layer serves as the nozzle plate 24 and the wall(s) 26. As mentioned previously, this structure can be formed with multiple layers. FIG. 27 shows the preferred embodiment after patterning and etching of the eighth dielectric layer 78. The nozzle orifice 22 is formed during this step.

Figure 28:
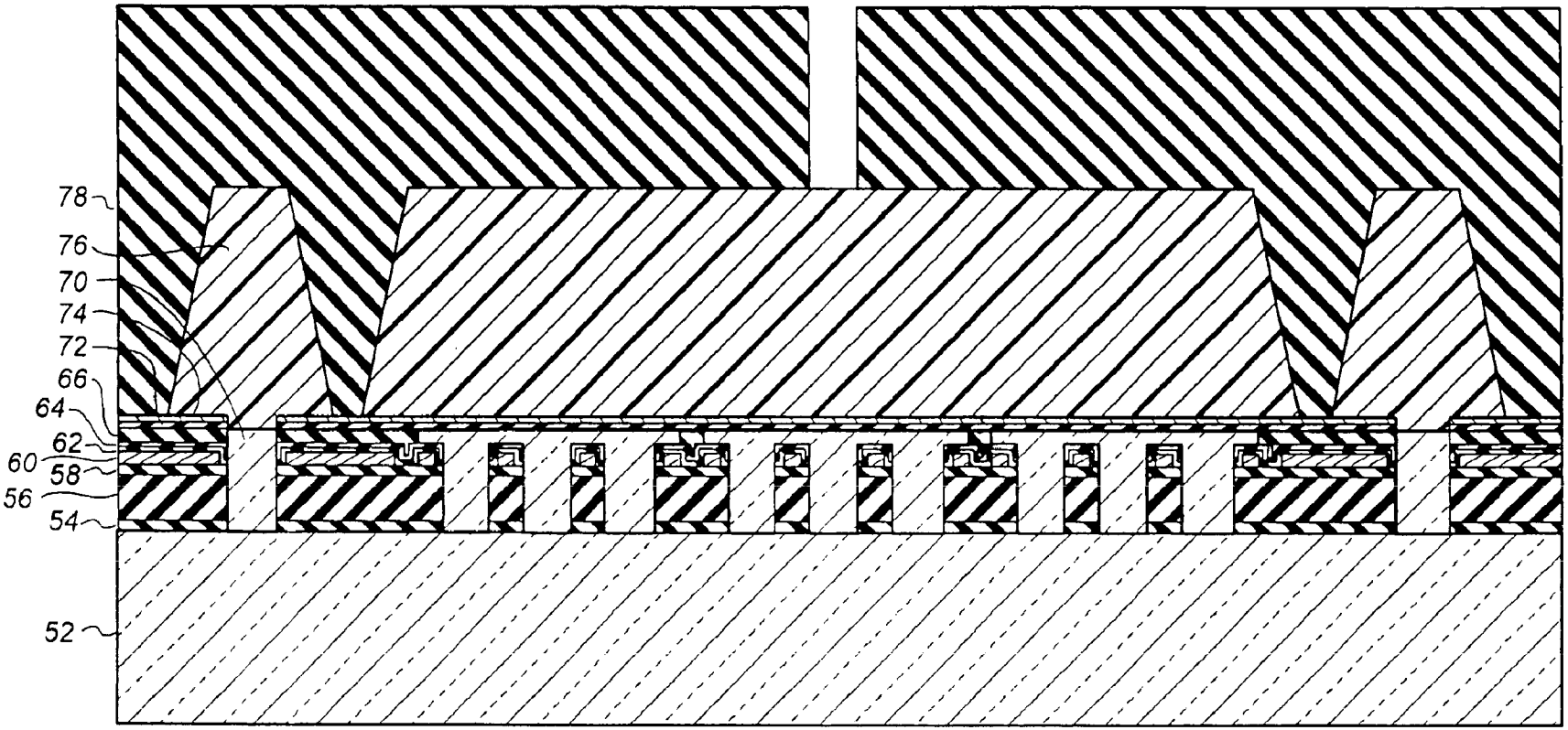

FIG. 28 shows the preferred embodiment after thinning the substrate 52 (e.g. by lapping or mechanical grinding). Any thin layers that have been deposited on the side of the wafer opposed to nozzle plate 24 are removed during this step.

Figure 29:
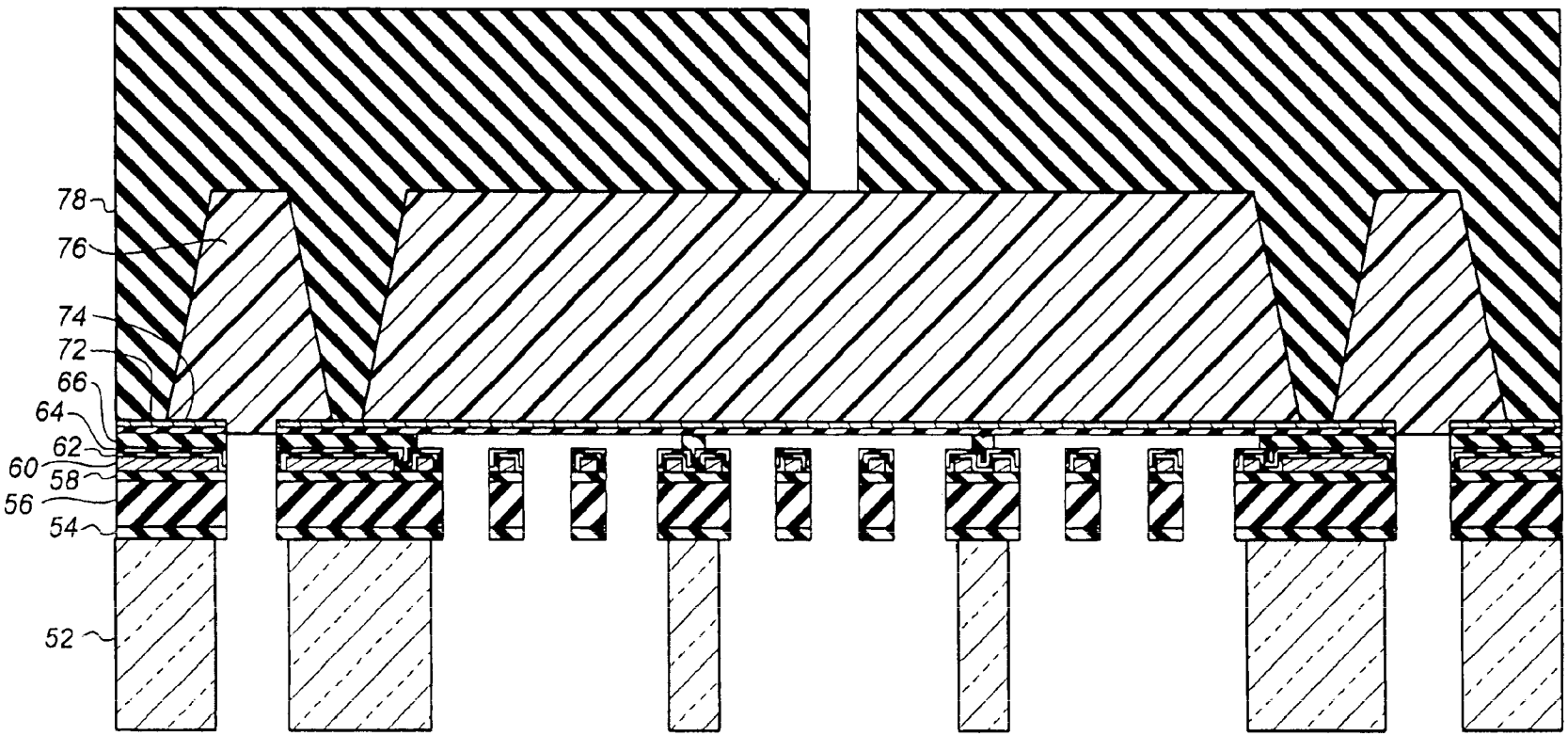

FIG. 29 shows the preferred embodiment after patterning and etching the backside of the substrate 52 (e.g. using a Bosch process), and continuing to etch isotropically to remove the first sacrificial layer 70. (e.g. using xenon difluoride gas). This extends the fluid conduits 48 and the fluid paths 50 through the substrate 52.

Figure 30:
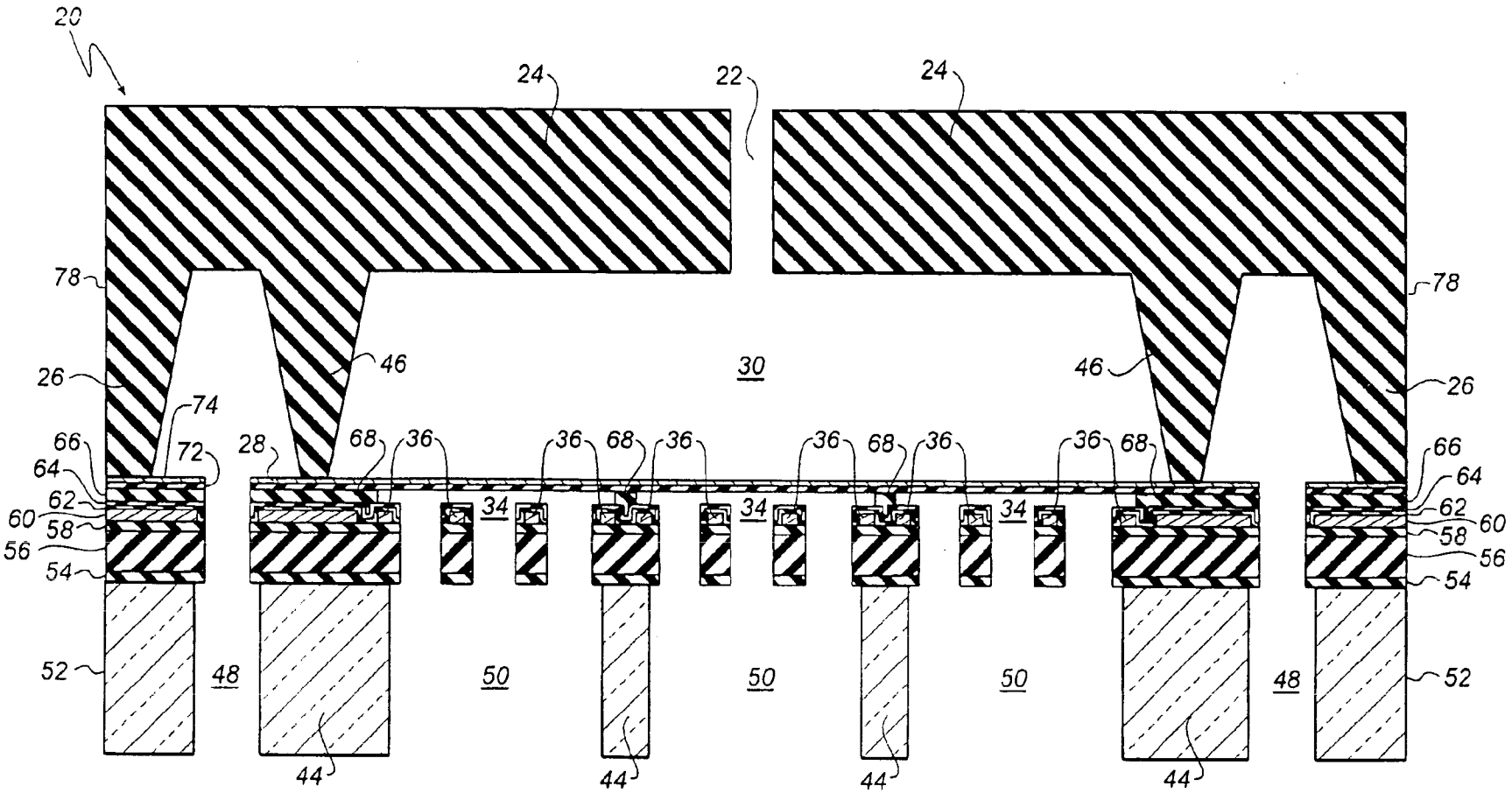

FIG. 30 shows the preferred embodiment after removal of the second sacrificial layer 76 (e.g. by isotropically etching polyimide with an oxygen plasma). The removal of the second sacrificial layer 76 creates the liquid chamber 30 that connects the nozzle orifice 22 with the fluid conduits 48 through refill ports 32. This steps completes formation of the mechanism 20. A continuous path to fluid region 34 through fluid path 50 is shown in FIG. 30. Although there does not appear to be a contiguous path from the fluid conduit 48 to the nozzle orifice 22 from the view shown in FIG. 30, a continuous path exists, shown in FIG. 31.

Figure 31:
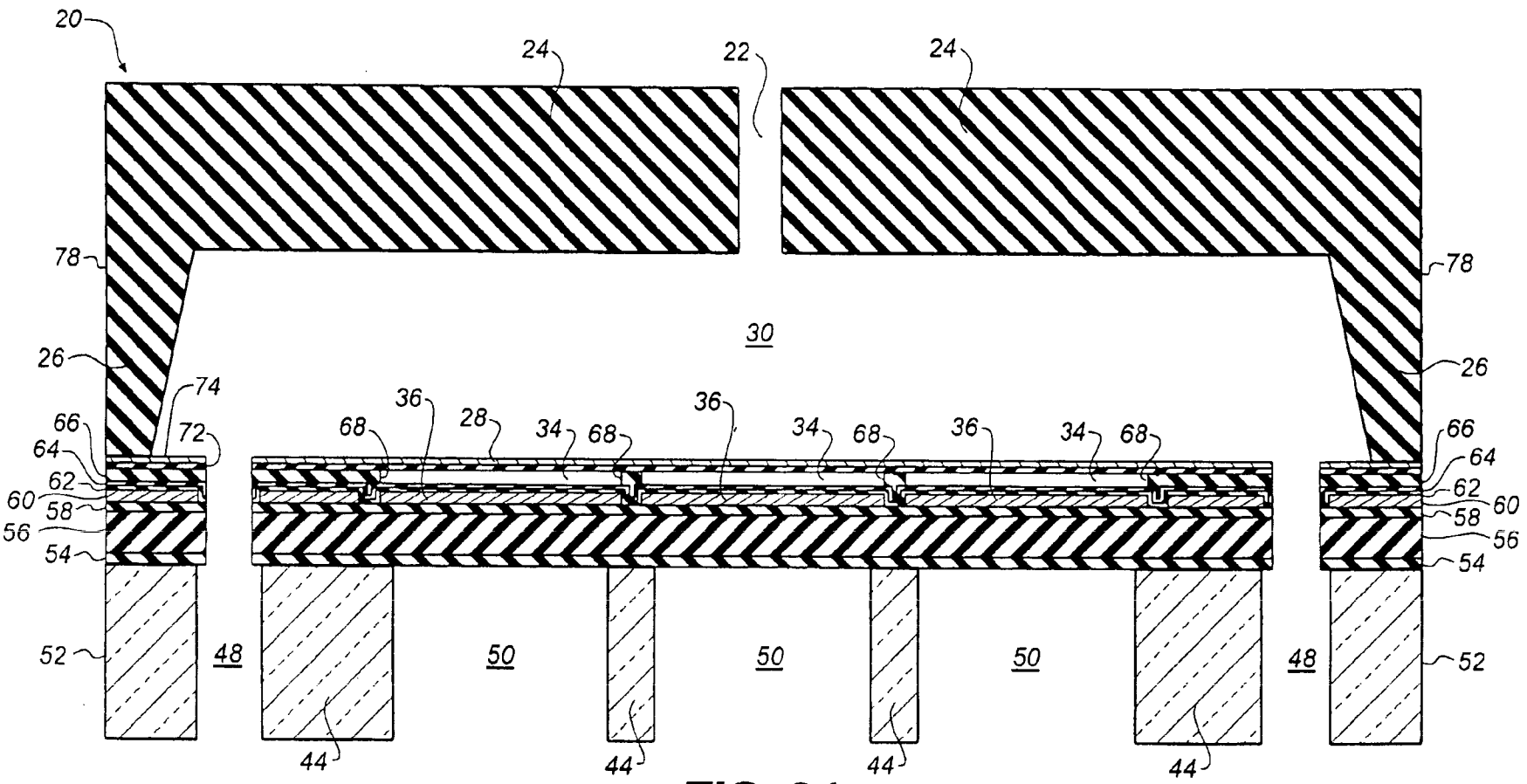
FIG. 31 shows a cross-section through line B–B' of FIG. 8.
Figure 33:
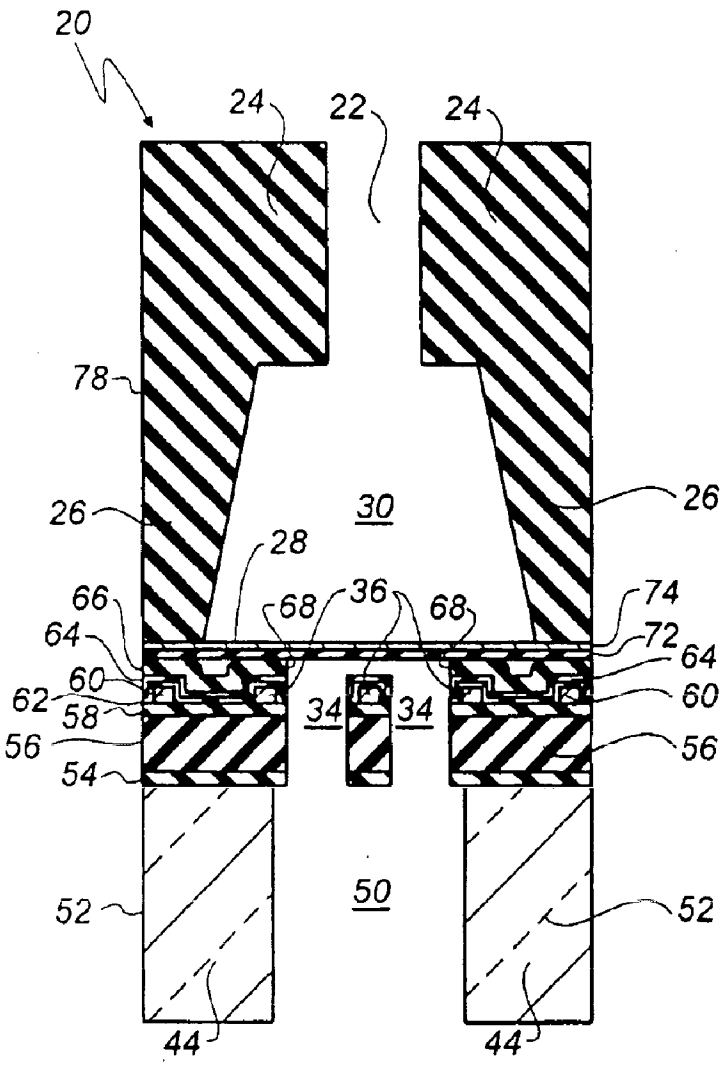
FIG. 33 shows a cross-section through line D–D' of FIG. 8.

FIG. 31 shows the preferred embodiment as viewed along line B–B' of FIG. 8. In FIG. 31, there is a continuous path from the fluid conduits 48 to the nozzle orifice 22 through refill ports 32 and liquid chamber 30. FIG. 32 shows the preferred embodiment as viewed along line C–C' of FIG. 8 in which fluid region 34 and flow restrictor 46 can be seen. FIG. 33 shows the preferred embodiment as viewed along line D–D' of FIG. 8 through nozzle orifice 22.

The invention has been described in detail with particular reference to certain preferred embodiments thereof, but it will be understood that variations and modifications can be effected within the scope of the invention.

PARTS LIST

10 Drop-on-demand liquid emission device
12 Source of data
14 Controller
16 Source of energy pulses
18 Inkjet printer
20 Electrostatic drop ejection mechanism
22 Nozzle orifice
24 Nozzle plate
26 Wall
28 First electrode
30 Liquid chamber
32 Refill ports
34 Fluid region
36 Second electrode
42 Electrical leads
44 Structural supports
46 Flow restrictor
48 Liquid conduit
50 Fluid path
52 Substrate
54 First dielectric layer
56 Second dielectric layer
58 Third dielectric layer
60 First conducting layer
62 Fourth dielectric layer
64 Fifth dielectric layer
66 Sixth dielectric layer
68 Pedestals
70 First sacrificial layer
72 Seventh dielectric layer
74 Second conductive layer
76 Second sacrificial layer
78 Eighth dielectric layer

What is claimed is:

1. An emission device for ejecting a liquid drop comprising:

a structure defining a chamber volume adapted to receive a liquid and having a nozzle orifice through which a drop of received liquid can be emitted;

a membrane portion of the chamber volume defining structure, the membrane portion having a plurality of individually deformable portions, each of the plurality of individually deformable portions being operatively associated with the nozzle orifice; and a controller adapted to selectively actuate at least one of the plurality of individually deformable portions.

2. The emission device according to claim 1, the structure defining the chamber volume including an outer wall, wherein the membrane portion is sealingly attached to the outer wall of the structure such that the received liquid is contained within the chamber volume.

3. The emission device according to claim 1, the membrane portion including a first electrode, the emission device further comprising:

a second electrode spaced apart from the membrane portion.

4. The emission device according to claim 3, further comprising:

at least one pedestal positioned between the membrane portion and the second electrode, the at least one pedestal defining each of the plurality of individually deformable portions of the membrane.

5. The emission device according to claim 4, wherein the at least one pedestal is electrically insulating.

6. The emission device according to claim 4, further comprising a fluid region located in the areas adjacent to the at least one pedestal.

7. The emission device according to claim 3, wherein the second electrode includes a plurality of segments, each of the plurality of segments of the second electrode being individually electrically addressable.

8. The emission device according to claim 3, wherein the controller is adapted to apply an electrostatic voltage differential between the membrane portion and the second electrode.

9. The emission device according to claim 1, wherein the emission device is a printhead of an inkjet printer.

10. The emission device according to claim 1, wherein the membrane portion is circular in shape.

11. The emission device according to claim 1, wherein the membrane portion is rectangular in shape.

12. An emission device for ejecting a liquid drop comprising:

a structure defining a chamber volume adapted to receive a liquid and having a nozzle orifice through which a drop of received liquid can be emitted;

an actuator having:

a first electrode associated with the chamber volume defining structure, the first electrode having a plurality of deformable portions, each of the plurality of individually deformable portions being operatively associated with the nozzle orifice; and a second electrode; and a controller adapted to selectively move at least one of the plurality of deformable portions.

13. The emission device according to claim 12, wherein the nozzle orifice is positioned over one of the plurality of deformable portions of the first electrode.

14. The emission device according to claim 12, further comprising a fluid region located between the first electrode and the second electrode.

15. The emission device according to claim 14, wherein the second electrode includes paths connecting the fluid region to a fluid reservoir.

16. The emission device according to claim 15, wherein the fluid is air and the fluid reservoir is ambient atmosphere.

17. The emission device according to claim 12, wherein the second electrode comprises a plurality of segments.

18. The emission device according to claim 17, wherein the controller is adapted to apply an electrostatic voltage differential between the first electrode and at least one of the plurality of segments of the second electrode.

19. The emission device according to claim 17, further comprising:

at least one pedestal positioned between the first electrode and the second electrode, the at least one pedestal being located between the plurality of segments of the second electrode.

20. The emission device according to claim 17, further comprising:

at least one pedestal positioned between the first electrode and the second electrode, the at least one pedestal being located over at least a portion of at least one of the plurality of segments of the second electrode.

21. The emission device according to claim 12, further comprising:

at least one pedestal positioned between the first electrode and the second electrode, the at least one pedestal defining each of the plurality of deformable portions of the first electrode.

22. The emission device according to claim 21, the second electrode comprising a plurality of segments, one of the plurality of deformable portions of the first electrode corresponding to one of the plurality of segments of the second electrode.

23. A method of operating a liquid emission device comprising:

providing a structure defining a chamber volume adapted to receive a liquid and having a nozzle orifice through which a drop of received liquid can be emitted;

providing a member associated with the chamber volume defining structure, the member having a plurality of deformable portions, each of the plurality of individually deformable portions being operatively associated with the nozzle orifice; and selectively actuating at least one of the plurality of deformable portions of the member such that the drop of received liquid is emitted through the nozzle orifice.

24. The method according to claim 23, further comprising:

providing an electrode, wherein selectively actuating at least one of the plurality of deformable portions of the member includes applying an electrostatic charge differential between the member and the electrode.

25. The member according to claim 23, further comprising:

providing an electrode having a plurality of individual segments, wherein selectively actuating at least one of the plurality of deformable portions of the member includes applying an electrostatic charge differential between the member and at least one of the plurality of individual segments of the electrode.

26. An emission device for ejecting a liquid drop comprising:

a structure defining a chamber volume adapted to receive a liquid and having a nozzle orifice through which a drop of received liquid can be emitted;

an actuator having:

a first electrode associated with the chamber volume defining structure, the first electrode having a plurality of deformable portions; and a second electrode;

a controller adapted to selectively move at least one of the plurality of deformable portions; and a fluid region located between the first electrode and the second electrode, wherein the second electrode includes paths connecting the fluid region to a fluid reservoir.

27. The emission device according to claim 26, wherein the fluid is air and the fluid reservoir is ambient atmosphere.

* * * * *

UNITED STATES PATENT AND TRADEMARK OFFICE

CERTIFICATE OF CORRECTION

PATENT NO. : 6,863,382 B2
DATED : March 8, 2005
INVENTOR(S) : Constantine N. Anagnostopoulos et al.

It is certified that error appears in the above-identified patent and that said Letters Patent is hereby corrected as shown below:

Title page,
Item [75], Inventors, delete "Michael N. Debar" and insert -- Michael J. Debar --.

Signed and Sealed this

Twenty-ninth Day of November, 2005

JON W. DUDAS
*Director of the United States Patent and Trademark Office*